US006474507B1

(12) United States Patent
Hornsby et al.

(10) Patent No.: US 6,474,507 B1
(45) Date of Patent: Nov. 5, 2002

(54) WATER GUN AMUSEMENT DEVICE

(75) Inventors: James R. Hornsby, St. Louis; Ryan A. Wolfinbarger, Maplewood; Joseph L. McGowan, St. Charles; Chad P. Stuemke, St. Louis; Marcellus R. Benson, Chesterfield; David B. Midgett, Sulpher Springs; Kurt V. Ulmer, S. Louis, all of MO (US)

(73) Assignee: Trendmasters, Inc., St. Louis, MO (US)

( * ) Notice: Subject to any disclaimer, the term of this patent is extended or adjusted under 35 U.S.C. 154(b) by 0 days.

(21) Appl. No.: 09/677,834

(22) Filed: Sep. 29, 2000

Related U.S. Application Data

(60) Provisional application No. 60/208,242, filed on May 31, 2000, and provisional application No. 60/157,153, filed on Sep. 30, 1999.

(51) Int. Cl.[7] ..... A63H 3/18

(52) U.S. Cl. ..... 222/79; 222/113; 222/396; 222/401

(58) Field of Search ..... 222/79, 61, 113, 222/175, 396, 401

(56) References Cited

U.S. PATENT DOCUMENTS

| | | | | |
|---|---|---|---|---|
| 4,239,129 A | | 12/1980 | Esposito | |
| 4,706,848 A | * | 11/1987 | D'Andrade | 222/79 |
| 4,750,641 A | * | 6/1988 | Chin-Fu | 222/79 |
| 4,768,681 A | * | 9/1988 | Dean et al. | 222/79 |
| 4,910,646 A | * | 3/1990 | Kim | 362/112 |
| 5,348,508 A | | 9/1994 | Garfinkel | |
| 5,549,220 A | * | 8/1996 | Whalen | 222/1 |
| 5,586,688 A | | 12/1996 | Johnson et al. | |
| 5,779,099 A | * | 7/1998 | D'Andrade | 222/79 |

* cited by examiner

*Primary Examiner*—Henry C. Yuen
*Assistant Examiner*—Melvin Cartagena
(74) *Attorney, Agent, or Firm*—Dorsey & Whitney LLP

(57) ABSTRACT

The present invention provides a toy water gun including a pump for pressurizing the gun for shooting out a stream of water, a trigger for controlling the flow of the water, and a source of electricity and at least one light source for illuminating the stream, wherein the device is adapted to provide a lighted coherent stream of water.

46 Claims, 27 Drawing Sheets

WATER GUN AMUSEMENT DEVICE

This application claims the priority of U.S. provisional patent applications, Ser. No. 60/157,153, filed Sep. 30, 1999, and Ser. No. 60/208,242, filed May 31, 2000.

BACKGROUND

The present invention relates to amusement devices and, more particularly, to an amusement device in the general form of a water gun toy such as those commonly referred to as "squirt guns."

Water and moving water is the source of much fascination and amusement, particularly when a person can actuate and control or manipulate a water source to provide a desired effect, including, as with the toy guns of the present invention, lighted and/or colored, long, powerful streams of water.

U.S. Pat. No. 4,239,129 discloses a toy water pistol with a reciprocal pump for building up pressure against a liquid for ejecting a stream thereof forwardly through a nozzle an appreciable distance, valve means for controlling the flow of the liquid, a source of electricity, light responsive means and lamps for constituting means for illuminating the stream, a buzzer and a switch for controlling the operation of the lamp and buzzer, and a trigger for simultaneously operating the valve means and switch. The water chamber or reservoir is mounted within an elongated barrel. A pump in the form of a piston, a piston rod, and rear handle is used to build air pressure within the reservoir or chamber. The air pressure from reciprocation of the piston within its cylinder forces air past a check valve and into the reservoir. The pressurized water is discharged from the reservoir through an outlet hose and it flows to a valve means. When the trigger is depressed to open the valve means against the biasing force of a spring, the pressurized water flows through an outlet hose to the nozzle at the front end of the gun. A lamp within a reflector is positioned immediately behind the nozzle to illuminate the stream of water. While the disclosed water pistol may be well-suited for its intended purpose, there is no disclosure or suggestion that the stream of liquid ejected by the pistol is coherent, or how to provide a lighted, coherent stream of liquid.

SUMMARY

In one embodiment, the present invention provides an amusement device in the general form of a water gun toy such as those commonly referred to as squirt guns, wherein, in use, the toy produces a lighted coherent "shot" or stream of liquid.

In one embodiment, the present invention provides a squirt gun for shooting a stream or burst of liquid, wherein the gun comprises a generally elongated housing having a front end, a rear end, an internal chamber for containing a liquid and a portion for containing a source of electricity, a conduit connected to the chamber and to a nozzle at the front end, a pump for pressurizing the chamber for forcing a stream of liquid through the conduit and out of the nozzle, valve structures suitable for controlling the flow of liquid, including for making the stream of liquid coherent, at least one light source adjacent to the front end for illuminating a stream of liquid, means for coupling and operating the means for illuminating and the source of electricity, and a trigger mechanism connected to the housing for actuating a stream of liquid.

In one embodiment, a "smaller" water gun design comprises a housing defining a barrel, a water chamber within the housing, an orifice with a removable quick fill cap allowing access to the water chamber, a handle with a trigger, a coherent flow nozzle, and a double stroke pump. The water chamber is hollow and, in some embodiments, the quick fill cap covers an orifice located on the top or upper side of the gun housing. An air inlet port is associated with the water chamber to allow air to be added to the chamber when the pump is reciprocated or operated to pressurize the water chamber. The chamber includes a water outlet port for allowing water to flow from the chamber when the trigger is pulled or depressed. The trigger is connected to a trigger valve for allowing water in the chamber to flow, via suitable conduits, to the coherent flow nozzle. In one embodiment, the nozzle includes a PVC-coated, reticulated foam plug that provides that the water flow from the nozzle is a coherent flow. The nozzle also includes a brass or other suitable metal tip. In one embodiment, the double stroke pump is situated below the barrel defined by the housing and is connected to the air inlet port. The pump has a stationery plunger or piston, a floating O-ring, and a movable cylinder portion with a one-way flap valve or valves so that it delivers air to the water chamber when the cylinder portion is manually pushed and pulled. There is a one-way ball-type valve in the air inlet orifice that prevents water from entering the pump.

In use, the double stroke pump is manually operated, i.e., reciprocated to deliver air through the air inlet port into the water chamber. The addition of air increases the pressure in the water chamber so that, when the trigger is pulled, the pressurized water is expelled from the water chamber through the water outlet port, past the trigger valve, and up to the nozzle. The water is expelled from the tip of the nozzle in a coherent flow due to the foam plug. The water flow continues as long as the trigger is pulled the until the pressure is diminished in the water chamber.

In one embodiment, the water gun amusement device or squirt gun toy of the present invention comprises a "larger" toy water gun comprising a housing defining an elongated barrel, a light source within the housing, an on/off switch for the light source, a coherent flow nozzle, a secondary light source, a handle with a trigger, a dual action or double stroke pump with a depending handle, and a water and air inlet/outlet arrangement. Any embodiment of the present invention, but particularly the "larger" embodiments, may be connected or coupled to a water-receiving and containing tank carried on the hip or to a back pack with a dual function air/water hose, and/or embodiments may be provided with one or more "in-gun" water receiving and containing chambers. The housing is hollow and contains within it and/or supports a light source, a battery pack and a temporary on/off switch for the light source, which may be activated by the trigger. The coherent nozzle may be generally similar to the coherent nozzle in the embodiment described above and may include a rod or other suitable light transferring device extending through the reticulated foam plug. The rod or light transfer device transfers light from the light source into an exiting stream of water. The secondary light source may be adjacent to the end of the barrel and may be located generally below the end of the nozzle.

The handle and trigger of this "larger" embodiment may be generally similar to the handle and trigger in the embodiment described above. The trigger is connected to a trigger valve, although it may not be directly dependent from the trigger valve. In this embodiment, the trigger is connected to the trigger valve with a valve rod that pulls the valve to an open position. The trigger has an upper extension, connected to the valve rod, which extends into the housing and which contacts the off/on switch when the trigger is pulled, thereby activating the switch. The off/on switch is temporary in that it automatically returns to an off position when the trigger is released. The dual action pump is constructed generally similarly to the double stroke pump in the embodiment described above and it may be operated under similar principles. The dual action pump in the present embodiment may be connected to an air tube which outlets through the water/air inlet.

In this embodiment, the water/air inlet/outlet is coupled to the water tank in the hip or back pack via a dual function hose. The hose has separate tubes for air pumped out of the gun by the dual action pump and for the water pressurized out of the water tank. The water tube connects to another water tube, via the inlet/outlet in the gun that carries the water to the nozzle when the trigger is pulled. The water tank has an inlet/outlet, generally similar to the present embodiment's inlet/outlet, whereby the dual function hose may be coupled to the tank. The tank also may have a quick fill cap covering an orifice for allowing the tank to be filled with water.

In use, the larger embodiment operates generally much like the smaller embodiment. The dual action pump is manually reciprocated, causing air to be pumped into the remote tank, via the dual function hose. As air is pumped into the tank, the pressure builds within the tank, pressurizing the water contained therein. When the trigger is pulled, the water is driven from the tank, through the dual function hose, and out the coherent flow nozzle. The water flow continues as long as the trigger is pulled and/or until the pressure is equalized in the water tank.

In any embodiment of the present invention, the trigger and/or trigger valve water releasing structure may comprise a trigger-valve arrangement as shown in U.S. Pat. No. 4,239,129, which patent is incorporated herein by reference. Generally, in one embodiment, the trigger valve mechanism comprises a valve casing having an internal sleeve at the forward end thereof, extending partially into the casing. A resilient seal or gasket is abutted against the end of the sleeve to serve as a valve seat. An annular valve member mounted on a shaft is biased by a spring to a normal seated position against the seal or seat. A second shaft coextensive with the first shaft extends through a bearing at the forward end of the casing and serves to mount a trigger button or trigger arm. A first conduit provides an inlet into the casing on the rear side of the annular valve member and a second conduit provides a outlet from the casing on the forward side of the annular valve member. As pressurized water enters the valve means through the inlet conduit, it cannot escape past the valve which is seated against the seal and it thus remains trapped in the rear part of the casing. However, when the trigger or trigger button is pressed inwardly or pulled, it overcomes the biasing force of the spring and moves the annular valve member from the seal. At this point the pressurized water can flow past the valve member and seal, to travel through the outlet conduct.

In any embodiment of the present invention, the pump of the present invention may comprise a generally solid piston having a floating O-ring around its periphery, a piston rod fixed at its rear end to the gun and carrying the piston at the forward end thereof, and a hollow pressurization cylinder slidably mounted on the piston and having one-way slap valves at opposite ends thereof. As a result, when the cylinder is pumped toward the gun it moves relatively to the piston, bringing the forward end of the cylinder close to the fixed piston on the inward stroke and moving the rear end of the cylinder toward the piston on the outward stroke.

In any embodiment, a quick fill port may be located on the top or upper portion of the gun as opposed to the side of the gun or water pack. This helps insure that the maximum water level determined by the position of the fill port will always be above the level of any air reservoir. In embodiments of the present invention, the piston for use in the pump of the present invention will be a hollow piston. While this type of double action or dual stroke pump pressurizes air on both the push and pull strokes rather than merely on the push stroke, other pump arrangements may be used.

In one embodiment, the present invention provides a water gun amusement device designed to "shoot" a coherent water beam having an entrained light beam wherein, at least initially as the water beam leaves the device, the water beam and light beam are coaxial. In another embodiment, parallel light beams illuminate the water beam.

In one embodiment, the present invention comprises a water gun amusement device comprising a generally gun-shaped housing with a nozzle at the end, wherein the nozzle is connected by a large volume intake hose to the gun. The central chamber of the nozzle is divided by a reticulated foam plug, suitable baffle, straw stack (e.g., a plurality of parallel tubular bodies bundled or arranged with their axis parallel to the central longitudinal axis of the nozzle) or the like into a rear swirl or turbulence chamber into which the water from the hose enters and a forward linear flow or coherent flow chamber from which the pressurized water is emitted through a sharply beveled orifice. Other turbulence reducing structures and methods adapted to provide a coherent water stream may be used, e.g., shaped chambers, chamber walls, or suitable fittings. A light transfer rod may extend partially through the nozzle into and/or past the forward end of the plug to direct light from the focused light source into the coherent stream of water being ejected through the orifice. Alternatively, a light source, e.g., an LED, may be potted or otherwise suitably mounted to emit or direct light to the forward end of the nozzle.

In one embodiment, the present invention provides a squirt gun amusement device including a direct pressure system comprising a water reservoir having an intake hose leading to the forward end of the barrel of the gun, an elongated barrel having an intake chamber at its forward end into which water from the intake hose can flow, a discharge hose connected between an outlet opening at the front of the intake chamber and the nozzle, a plunger and seal piston arrangement slidable within the barrel, a handle extending beyond the rear of the barrel connected to a piston rod which attaches to the plunger and the seal, and a handle locking means and a biasing spring which propels the plunger forwardly in the barrel when the locking means is released.

In another embodiment of the present invention, the water gun amusement device may comprise a foot operated system comprising a collapsible bellows employed to send pressurized air through a tube to the barrel of the gun.

In any embodiment, the toy guns of the present invention are adapted to shoot a coherent stream of water which, in some embodiments, may be lighted by one or more gun-carried light sources.

BRIEF DESCRIPTION OF THE DRAWINGS

FIG. 7, comprising

FIG. 9, comprising

FIG. 11, comprising

FIG. 12, comprising

FIG. 18, comprising

FIG. 25, comprising

DESCRIPTION

Figure 1:
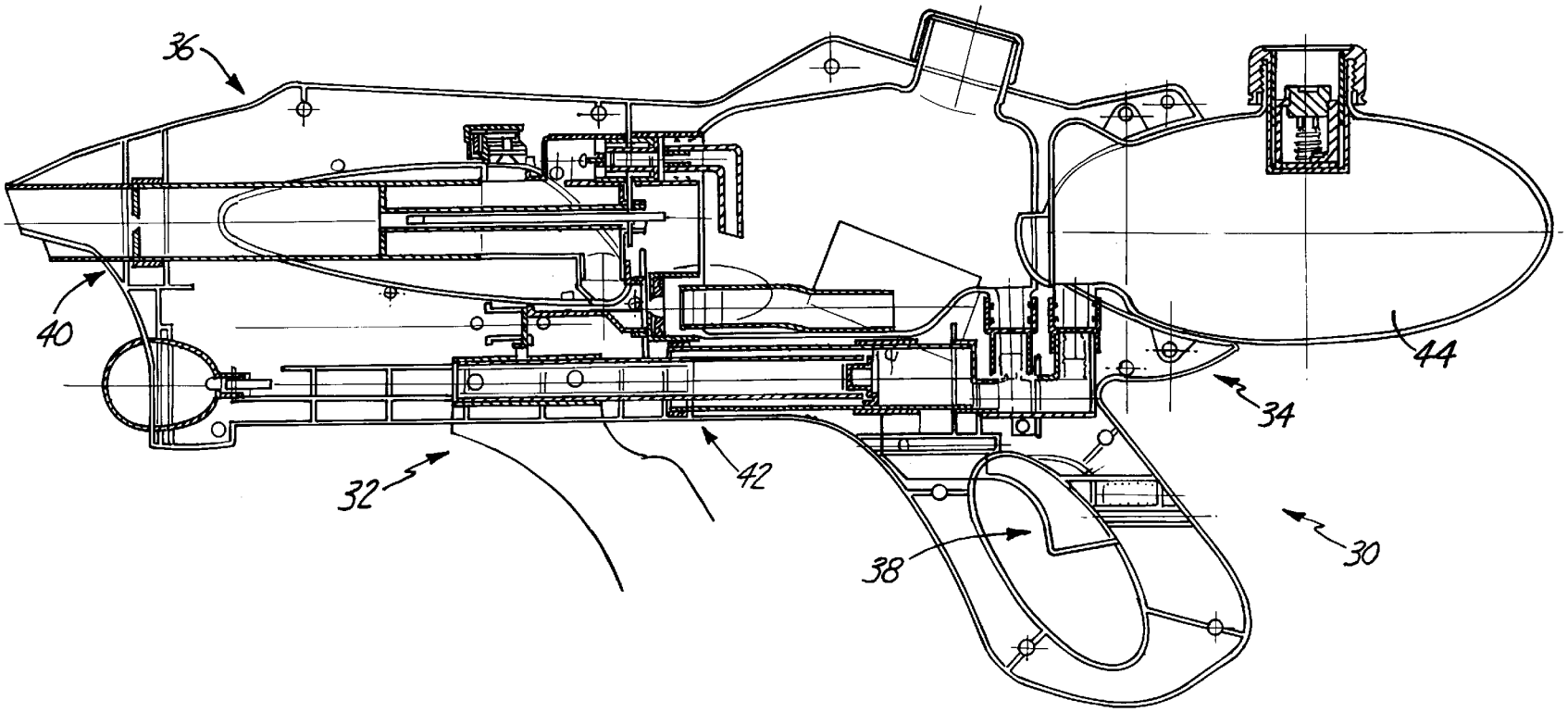
FIG. 1 is a cross-sectional view depicting one embodiment of the toy gun amusement device of the present invention.

The accompanying Figures and this description depict and describe embodiments of a water gun amusement device in accordance with the present invention, and features and components thereof. The present invention also encompasses a method of making and using embodiments of the amusement device. As used herein, the phrases or terms "water gun amusement device," "toy gun," "water gun," "squirt gun" and the like are intended to encompass a structure or structures adapted project, throw, squirt, launch or shoot a generally liquid material, such as water or the like, in a continuous stream or a broken stream of repeated, single "shots," bursts, doses or quantities of water or the like, including amusement devices of the type generally known as "squirt guns."

With regard to fastening, mounting, attaching or connecting components of the present invention to form the water gun amusement device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like. Unless specifically otherwise disclosed or taught, materials for making components of the present invention may be selected from appropriate materials such as metal, metallic alloys, natural and manmade fibers, vinyls, plastics and the like, and appropriate manufacturing or production methods including casting, pressing, extruding, molding and machining may be used.

Any references to front and back, right and left, top and bottom and upper and lower are intended for convenience of description, not to limit the present invention or its components to any one positional or spacial orientation.

Referring to FIGS. 1–5, embodiments of a toy water gun amusement device 30 in accordance with the present invention are depicted. Each of the depicted embodiments includes a generally gun-shaped (e.g., pistol, rifle or the like) body 32 having a stock portion 34 and a barrel portion 36. Each embodiment includes a suitable trigger mechanism assembly 38 for actuating the gun, a nozzle assembly 40 for emitting a stream of liquid, and a pump assembly 42 for pressurizing the gun. The depicted embodiments include a water or liquid receiving and/or containing pressurization tank or chamber 44; some embodiments have more than one such chamber 44 (see, e.g., FIGS. 1 and 2), in which case one such chamber may be a water containing chamber, and the other chamber may be used for further or additional pressurization of a liquid therein. Also, in some embodiments (see, e.g., FIGS. 24 and 25), there may be no gun-carried chamber, use being made of an external supply or source of liquid, including such a source or supply which may be pressurized by the pump assembly 42 of the gun 30. Certian components of the squirt gun amusement device 30 of the present invention are common to the depicted embodiments and are commonly numbered in FIGS. 1–5 and the rest of the Figures.

With continued reference to FIGS. 1–5, the body 32 of the amusement device in accordance with the present invention is generally hollow and is adapted to support and/or contain the trigger mechanism 38, the nozzle assembly 40 and the pump assembly 42. Additionally, the body 32 provides a housing for other operational components, including suitable electrical components and suitable liquid-conducting conduits and chambers for containing a liquid such as water.

Figures 7A, 7B:
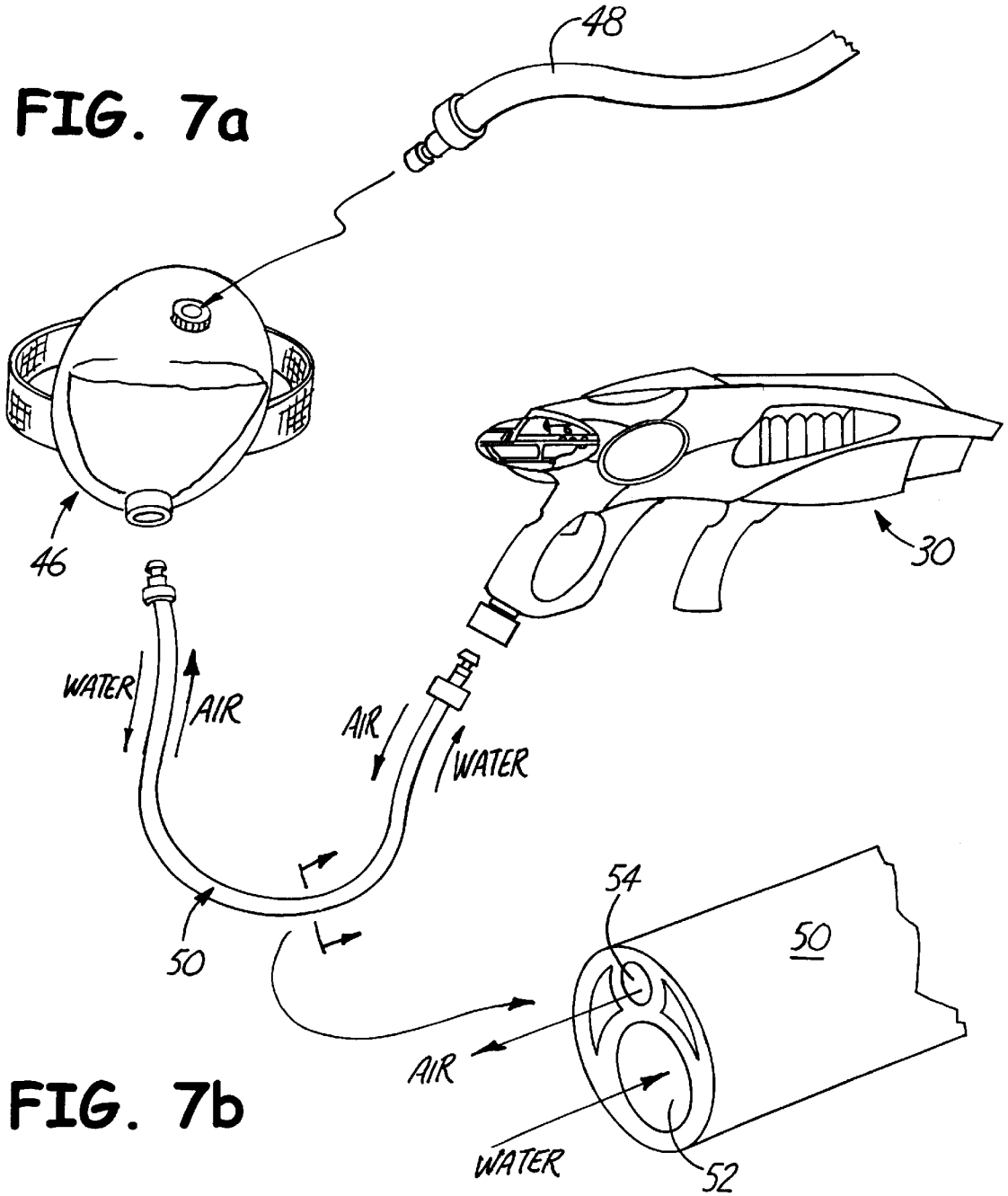
FIGS. 7*a* and 7*b*, depicts one embodiment of the toy gun of the present, including embodiments of peripheral equipment or components of the invention and their use.

Referring to FIG. 7*a*, the toy gun amusement device 30 of the present invention may be adapted for use with an external water supply chamber 46, and/or any embodiment of the toy 30 or external supply 46 may be coupled directly to a source of pressurized water such as a garden hose 48 or typical spigot (not shown). When the external supply 46 is used, a suitable connector or transfer hose 50 may be used to operably link the gun 30 and supply 46. Referring to FIG. 7*b*, the hose 50 provides a water flow channel 52 and an air flow channel 54.

Figure 25A:
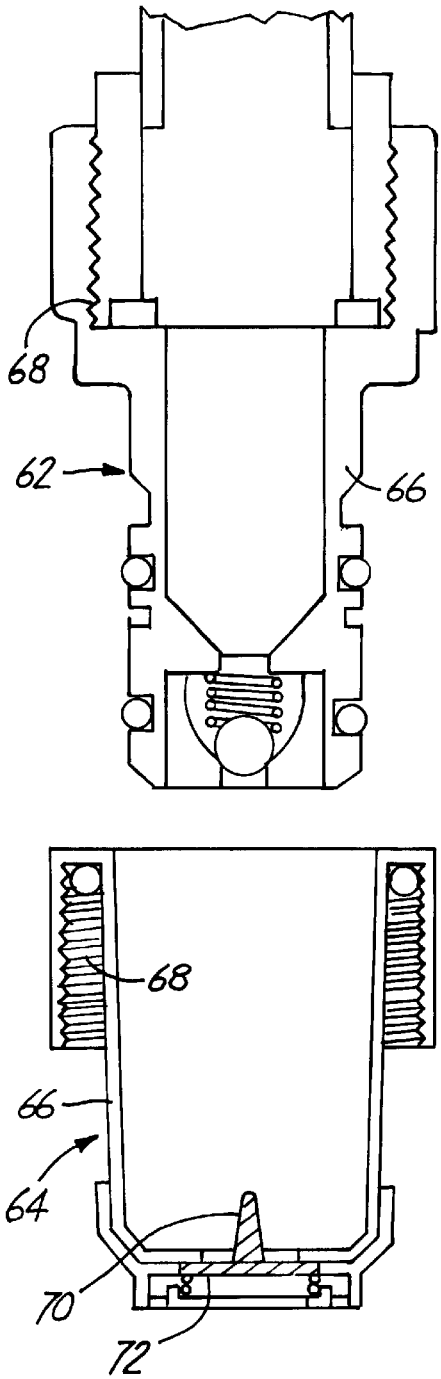
FIGS. 25*a* and 25*b*, depicts an embodiments of a "quick fill" structure and function for use with the amusement devices of the present invention.
Figure 25B:
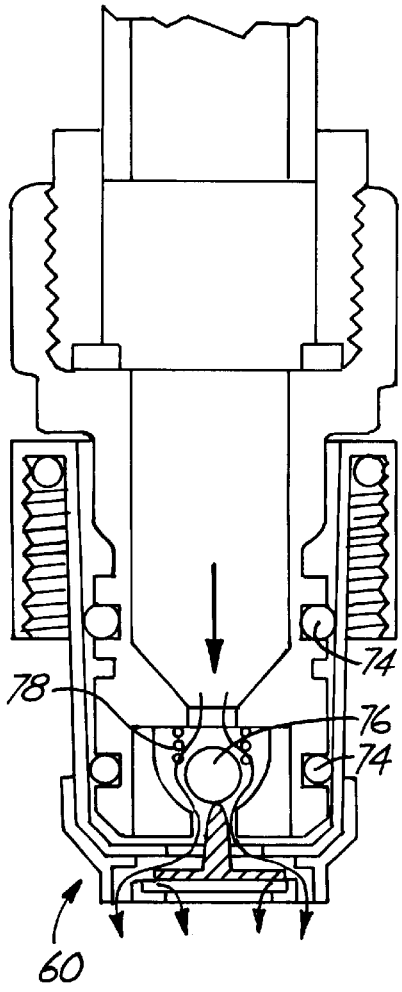
Figure 26:
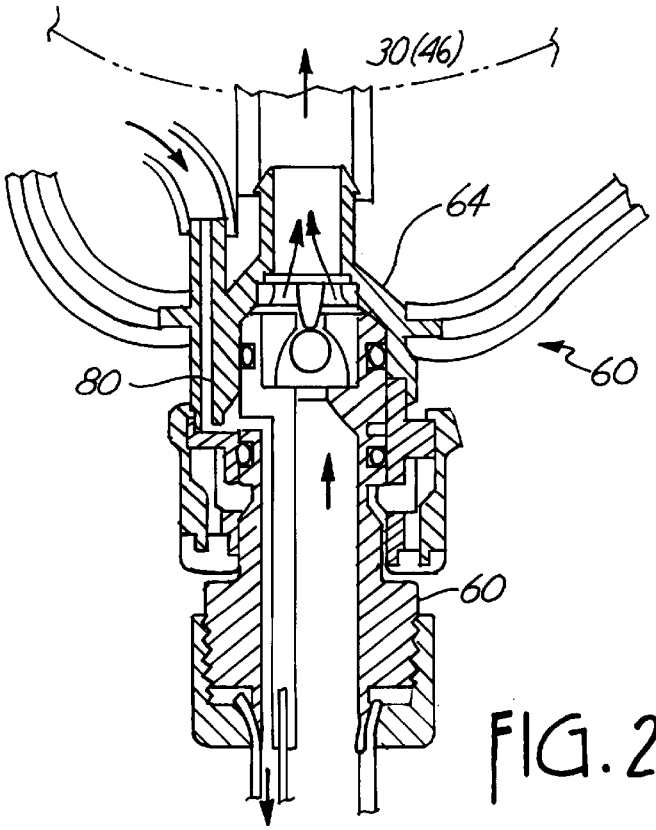
FIG. 26 depicts an embodiment of the quick fill structure, and water and air flows therethrough.
Figure 27:
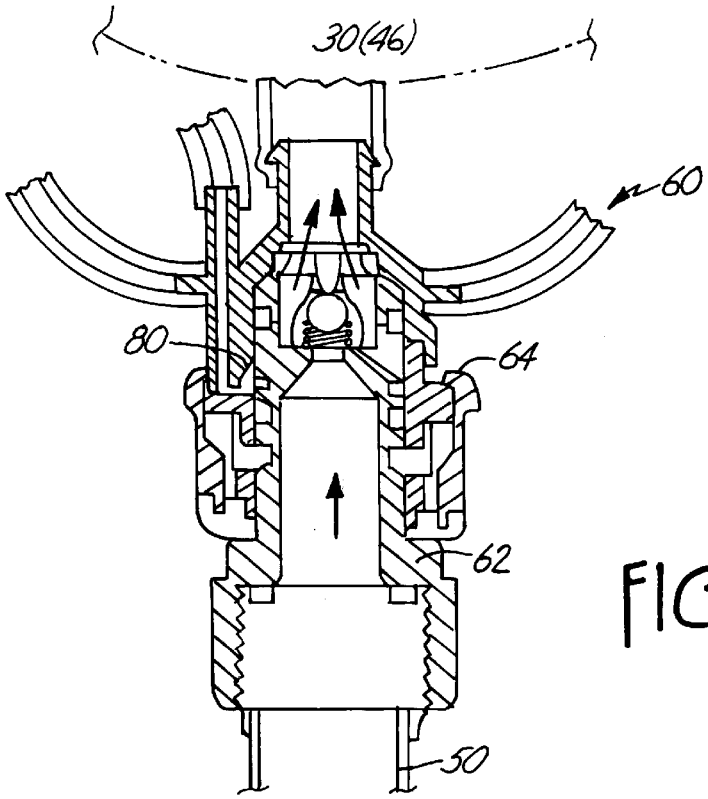
FIG. 27 depicts another embodiment of the quick fill structure.

With further reference to FIG. 7, and referring to FIGS. 25–27, the toy guns in accordance with the present invention and/or the external water containing tanks may be adapted to be filled quickly from a source of pressurized water and connect to the external water containing tanks by use of a quick fill adaptor fitting 60. Referring specifically to FIGS. 25*a* and 25*b*, the quick fill connector fitting 60 comprises a male connector form 62 and female connector form 64. Each comprises a generally tubular body 66 with typical threaded hose-type connections 68 at each end. The female connector 64 includes a ball plunger 70 and flap valve 72. The tubular body 66 of the male connector includes suitable seals 74, a water ball 76 and spring 78 for urging the ball toward its closed position, basically comprising a one way valve for allowing water to flow into a water receiving tank or chamber. Water flow is depicted in FIG. 25*b*. FIG. 26 depicts a quick fill fitting 60 modified to quickly couple and uncouple a transfer hose 50 to a gun 30 when an external water supply is being used. The complimentary male and female connectors 62, 64 have been adapted to provide for the flow of air from the pump by providing a duct 80; the flow of water from the external supply tank is also shown. The duct 80 may be provided in either or both of the connectors 62, 64 as necessary. Note that the female portion 64 may be formed integrally with or removably coupled to the gun and/or the external supply tank 46. FIG. 27 depicts an arrangement wherein the quick fill fitting is adapted to couple a source of pressurized water, e.g., a garden hose, directly to a gun 30 or tank 46. The fittings may be integrated with a gun or remote water supply tank.

Figure 28:
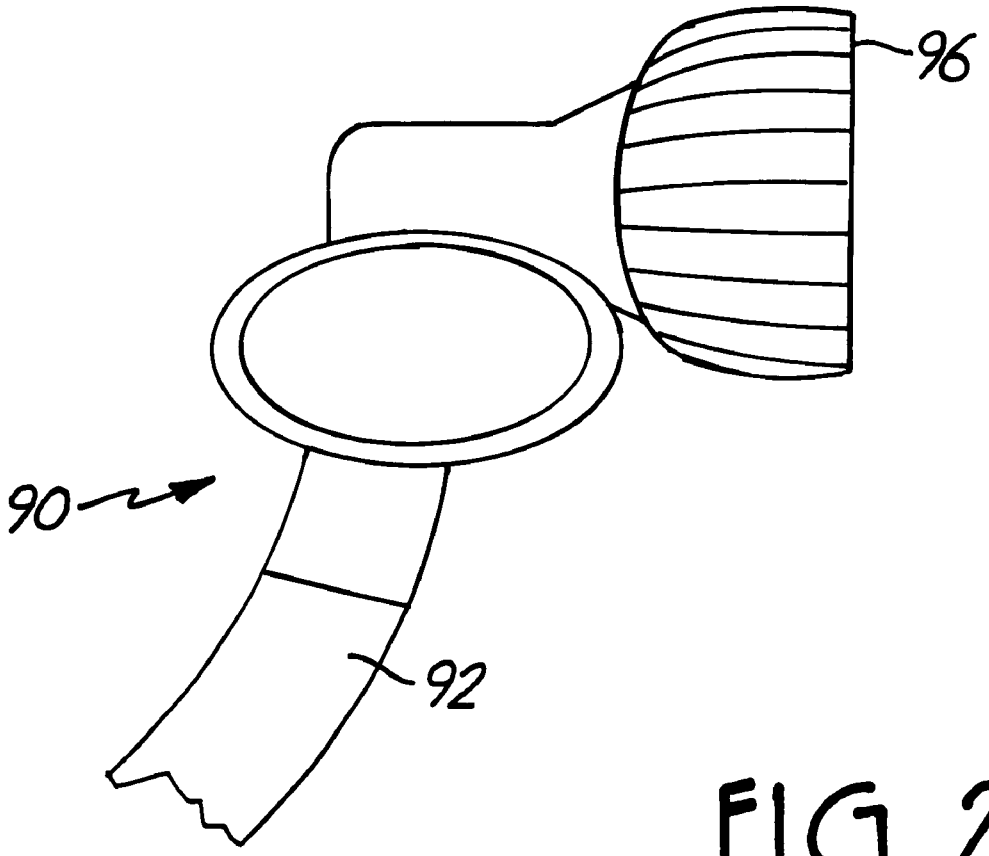
FIG. 28 depicts an embodiment of a connective structure for connecting a toy squirt gun in accordance with the present invention to a water source.

Embodiments of the toy gun amusement device of the present invention are adapted to be used with a connecting device 90 which may be known as the "Unlimitor." One end of the connecting device is depicted in FIG. 28. The device 90 comprises a selected length of suitable liquid-conducting conduit 92 having a suitable attachment fitting 96 at each end. In some embodiments, as shown at fitting 96, one or both of the fittings 96 may be bent or angled at a selected angle to facilitate coupling to the gun and/or to a water source. In use, the "Unlimitor" 90 may be coupled to a source pressurized water such as the typical house spigot so that, when the trigger is pulled to acuate the gun 30, a constant unending stream of water is shot from the gun as long as the trigger is pulled. The "Unlimitor" 90 thus obviates the need to refill or recharge the liquid-containing chamber associated with the gun 30 or the external water supply.

Figure 8:
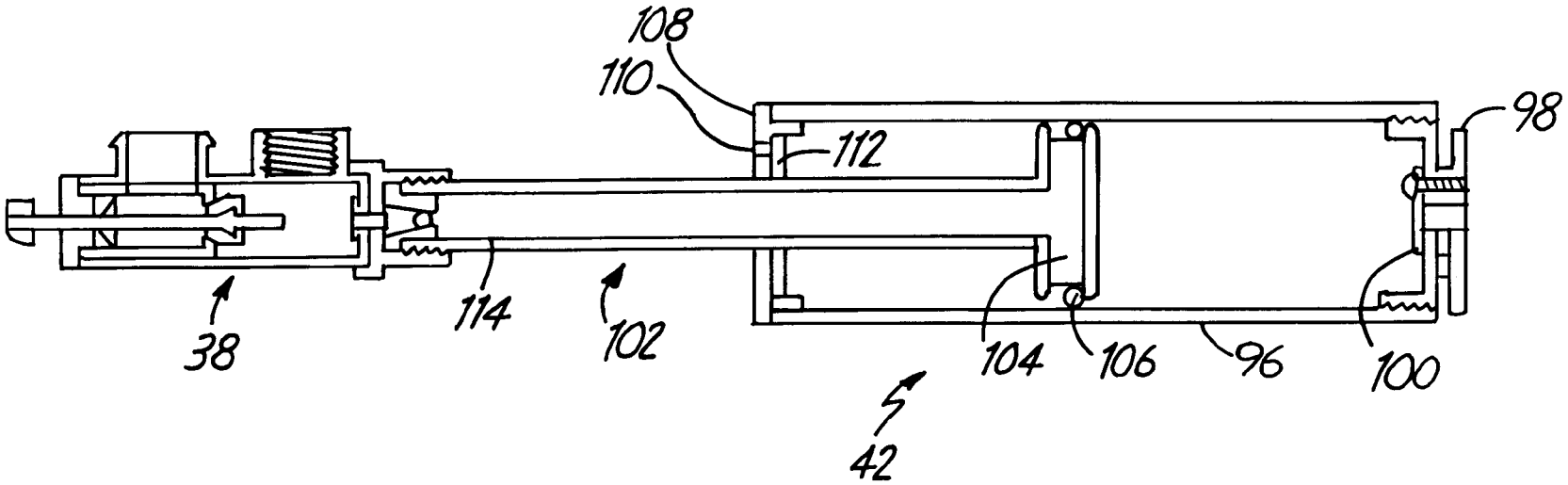
FIG. 8 depicts one embodiment of a pump assembly for use with the squirt gun amusement devices of the present invention.
Figure 9A:
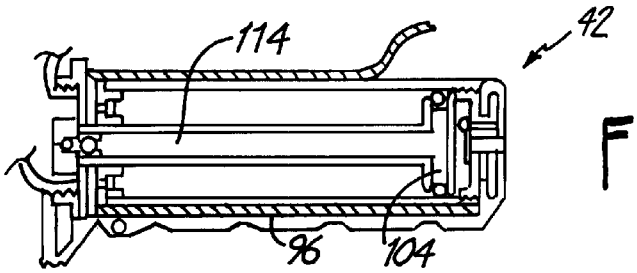
FIGS. 9*a*, 9*b*, 9*c* and 9*d*, depicts the operation of the pump assembly of FIG. 8.
Figure 9B:
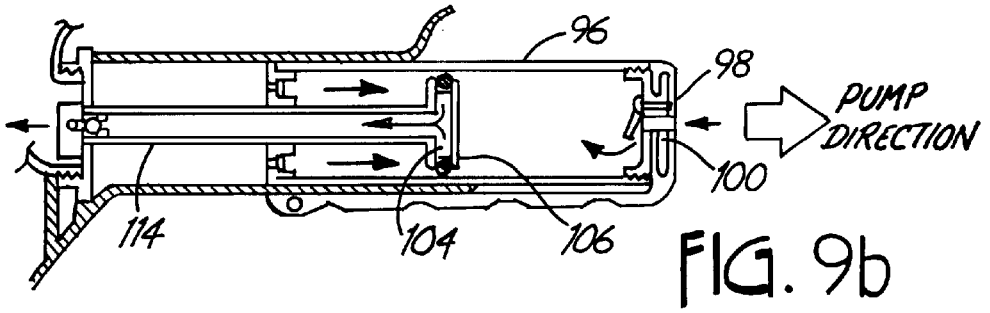
Figure 9C:
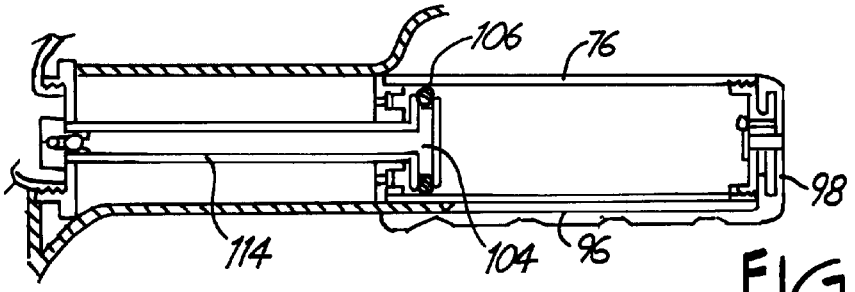
Figure 9D:
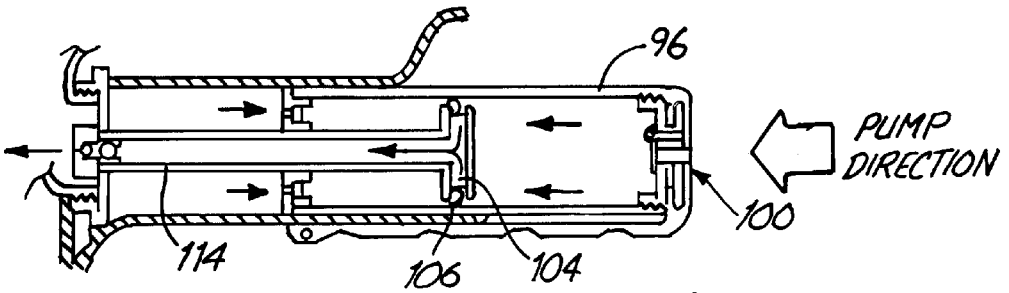

One embodiment of the pump assembly 42 for use with embodiments of the toy gun amusement device 30 of the present invention is depicted in FIG. 8. The pump assembly 42 consists of a generally cylindrical pump body 96 and a pump cap 98 mounted to the body with a suitable flap valve or the like 100 just behind the pump cap 98. The pump body 96 receives a piston sub-assembly 102 comprising a piston 104 carrying a movable or "floating" O-ring 106. The other end of the pump body 96 is closed by a end plate member 108. In one embodiment, the end plate 108 may comprise a pair of disc plates equipped with suitable apertures 110 and flap valves 112 for controlling and/or permitting airflow, and a central opening in the parallel disc plates for receiving the fixed arm 114 of the piston assembly 102. The plate 108, and thus the pump body 96, can slide freely over the piston arm 114, and the pump 42 is designed to allow the passage of air in both directions depending on the position of the floating O-ring 106 as described below. The end of the piston arm 114 is threaded to be mounted adjacent to or received in the trigger assembly 38. Referring to FIGS. 9*a*, 9*b*, 9*c* and 9*d*, the pump 42 is designed to provide air on both push and pull strokes. FIG. 9*a* depicts the pump 42, particularly the pump body 96, in a compressed position. FIG. 9*b* depicts the movement of the pump body 96 in a push direction (away from a user holding a gun 30 of the present invention) with air being pumped in the direction of the arrows. Note that the floating O-ring 106 carried by the piston 104 is moved by friction against the inside of the pump body 96 to create a seal, and the valve 100 at the end of the pump body 96 operates to permit airflow into the body and, ultimately, through the piston and into the water chamber 44 associated with the gun 30 (see, e.g., FIG. 24). FIG. 9*c* depicts the pump in extended position, and FIG. 9*d* depicts the opposite or pull stroke of the pump 42 wherein the flap valve 100 is forced closed and the floating O-ring 106 is moved to a back position to allow air to flow through the piston 104, piston arm 114, and into the water chamber 44. While this embodiment may be used with any embodiment of the present invention, other pumping arrangements may be suitable as long as the water chamber is adequately pressurized.

Figure 10:
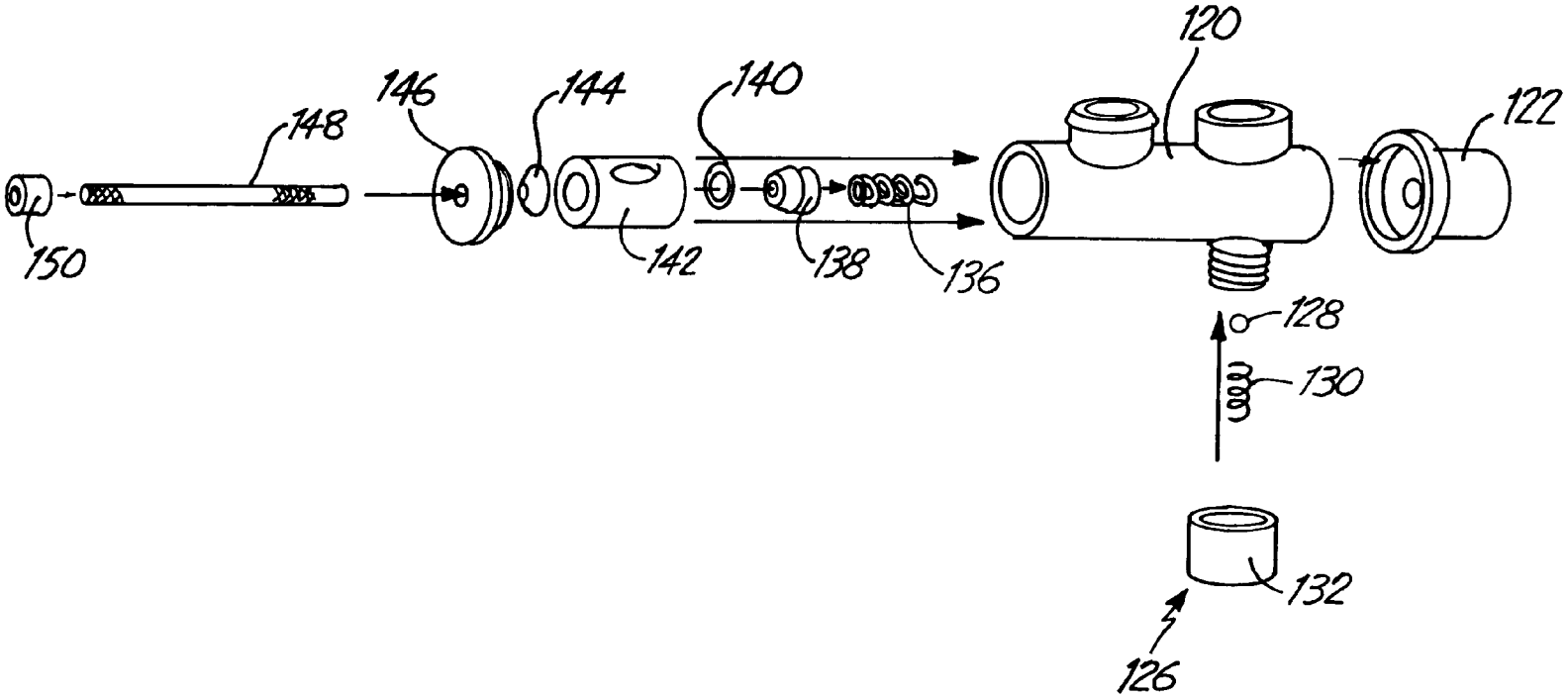
FIG. 10 is an exploded assembly view depicting an embodiment of a trigger assembly for use with the amusement devices of the present invention.

Referring to FIG. 10, one embodiment of a trigger assembly 38 for use with embodiments of the present invention is depicted. The trigger assembly 38 includes a trigger valve chamber 120 one end of which receives a threaded cap 122. At a suitable location along the length of the trigger valve chamber 120, a purge valve 126 is provided and includes a ball 128, spring 130 and a purge cap 132 which is screwed on to the trigger valve assembly 38, and which may lead to a suitable purge port or port 134. The function of the purge valve 126 is to relieve excess pressure by venting pressurized air and/or water when the pressure exceeds a selected point. The generally tubular trigger valve chamber 120 receives a spring 136, a trigger plug 138, a gasket 140, an insert plug 142, a trigger diaphragm 144 and a trigger cap 146. A knurled steel pin 148 is received generally centrally and axially within the internal assembly of the trigger assembly 38 inside the trigger valve chamber 120, and a pin cap 150 is attached to one end of the pin 148, the other end of the pin 148 being connected to the trigger plug 138. The trigger assembly 38 thus constitutes a generally water or liquid tight valve or flow control mechanism or structure operable to actuate and control a stream or "shot" of water.

Figure 11A:
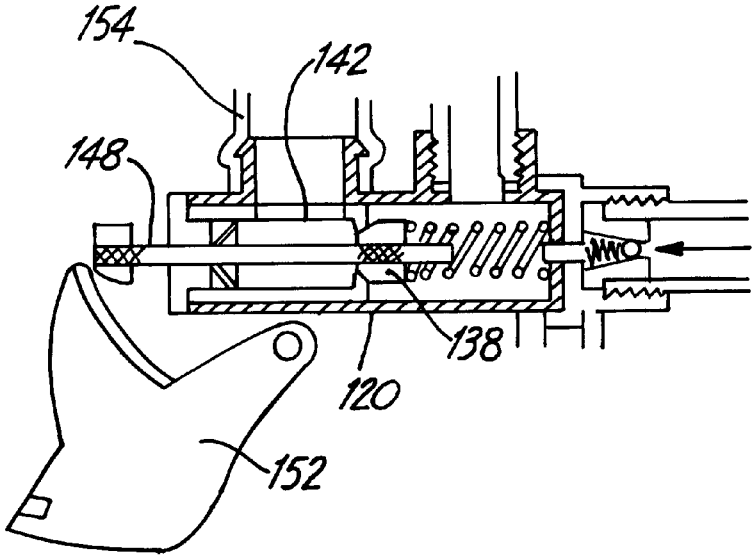
FIGS. 11*a* and 11*b*, depicts the function of the trigger assembly.
Figure 11B:
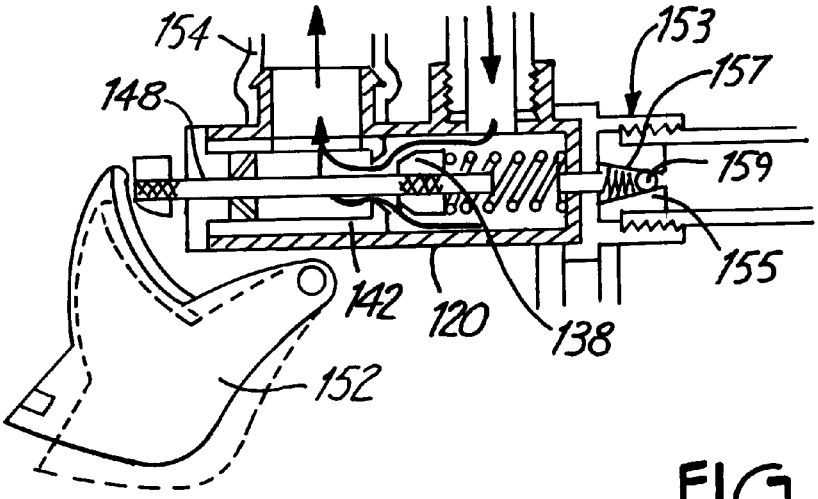

Referring to FIGS. 11*a* and 11*b*, the function of an embodiments of the trigger assembly 38 is depicted. In FIG. 11*a* no water flow is possible, i.e., the trigger member 152 is not pulled. Specifically the stopper or trigger plug 138 is seated against the insert 142, thereby not permitting water to pass into the tube or conduit 154 leading to the nozzle assembly 40 of the gun 30. Another feature of the trigger assembly 38 is depicted in FIGS. 11*a* and 11*b*, too, namely, a one-way valve 153, comprising a seat 155, spring 157 and ball 159 in one embodiment, is provided between the pump assembly 42 and the trigger assembly 38 to prevent water from passing into the hollow piston arm 114. FIG. 11*b* depicts what happens when the trigger 152 is pulled. The trigger pin 148 is advanced against the pressure of the spring 136, unseating the stopper 138 from the insert 142. Water is thus allowed to flow from the chamber 44, through the trigger assembly and into the conduit 154 leading to the nozzle assembly 40. When the trigger 152 is released, the spring 136 inside the trigger assembly 38 returns the trigger 152 to its rest or closed position and the water flow stops.

Figure 12A:
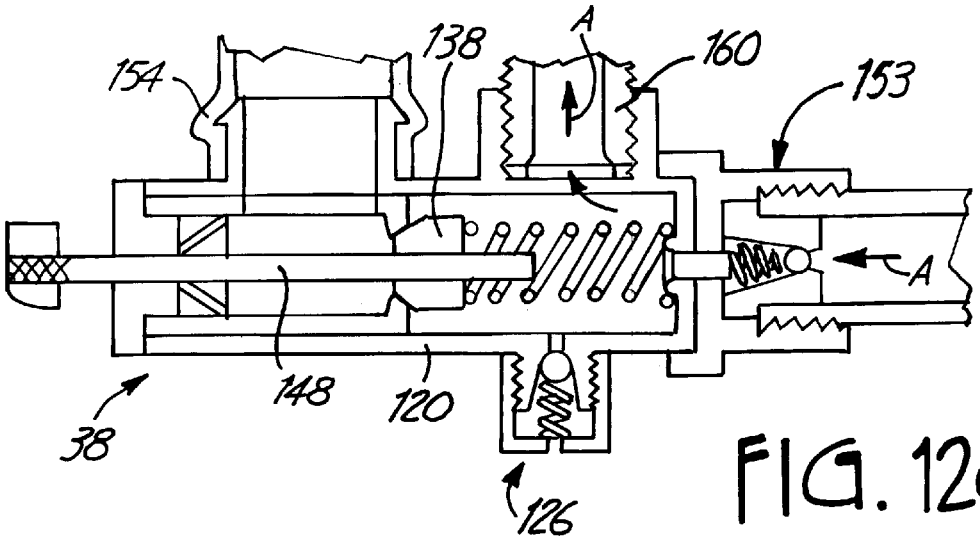
FIGS. 12*a* and 12*b*, depicts an embodiment of a purge valve arrangement for use with the present invention.
Figure 12B:
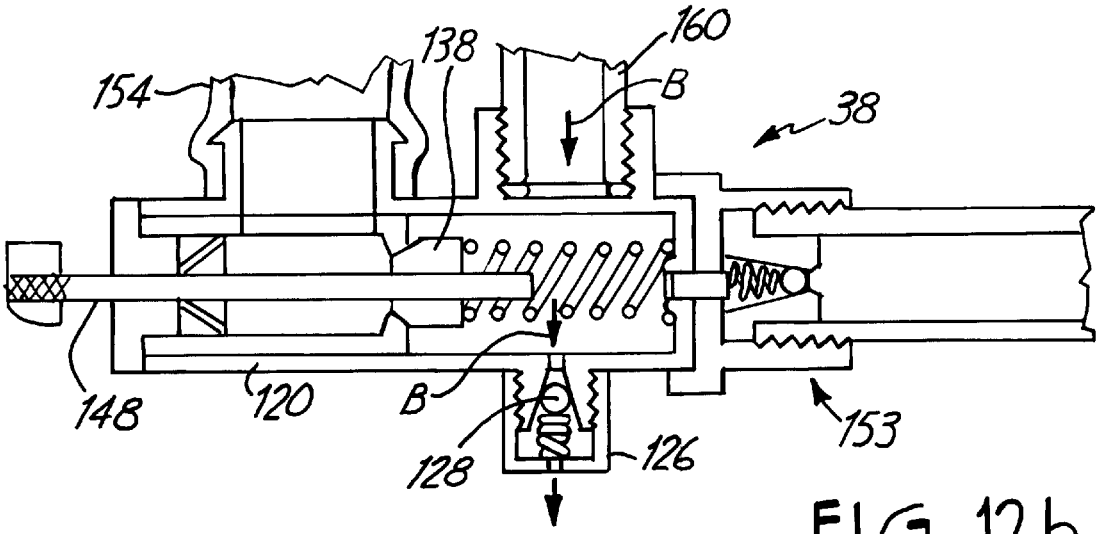
Figure 13:
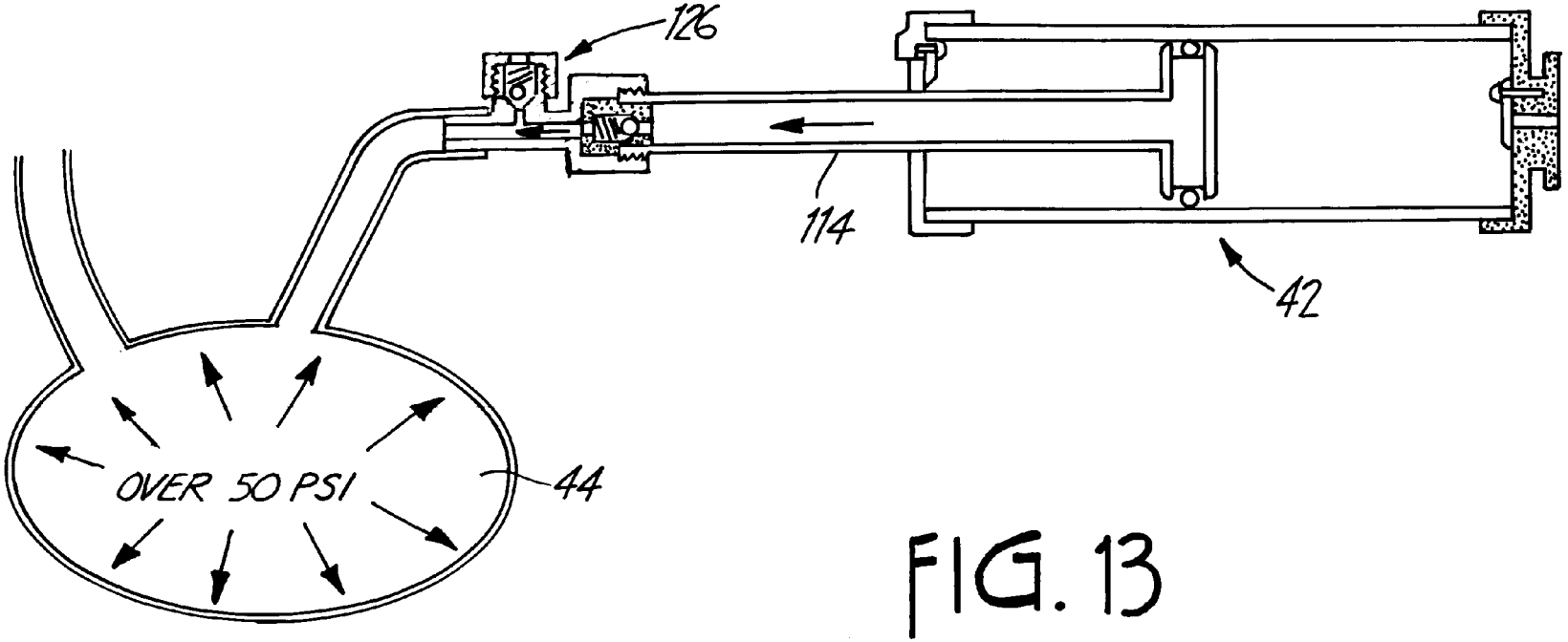
FIG. 13 depicts another embodiment of a purge valve.

FIGS. 12*a* and 12*b* depict the function and/or operation of the trigger assembly 38 and the purge valve 126. When the pump assembly 42 (only piston arm 114 is visible) is operated, air is compressed and moved (flow is shown at arrows A) past the valve 153 directly into the trigger chamber 120 and conduit 160 to pressurize the water reservoir or chamber 44 (not shown). As depicted in FIG. 12*b*, if a preselected pressure is exceeded, air flows as shown by arrows B, the pressure moving the ball 128 of the purge valve 126 as depicted. This purging or safety release of pressure may occur at a preselected pressure, 50 pounds in one embodiment. At the selected pressure, the ball 128 is forced away from its seat and air and water may escape. An alternative position of the purge valve 126 is depicted in FIG. 13, which omits depiction of the trigger assembly for clarity, and the purge valve may be located anywhere suitable along the flow path of pressurized water or water chambers. Again, as the pump 42 is operated to pressurize the water chamber 44, if the pressure exceeds a preselected pressure, the purge valve 126 functions to release the excess pressure.

Figure 14:
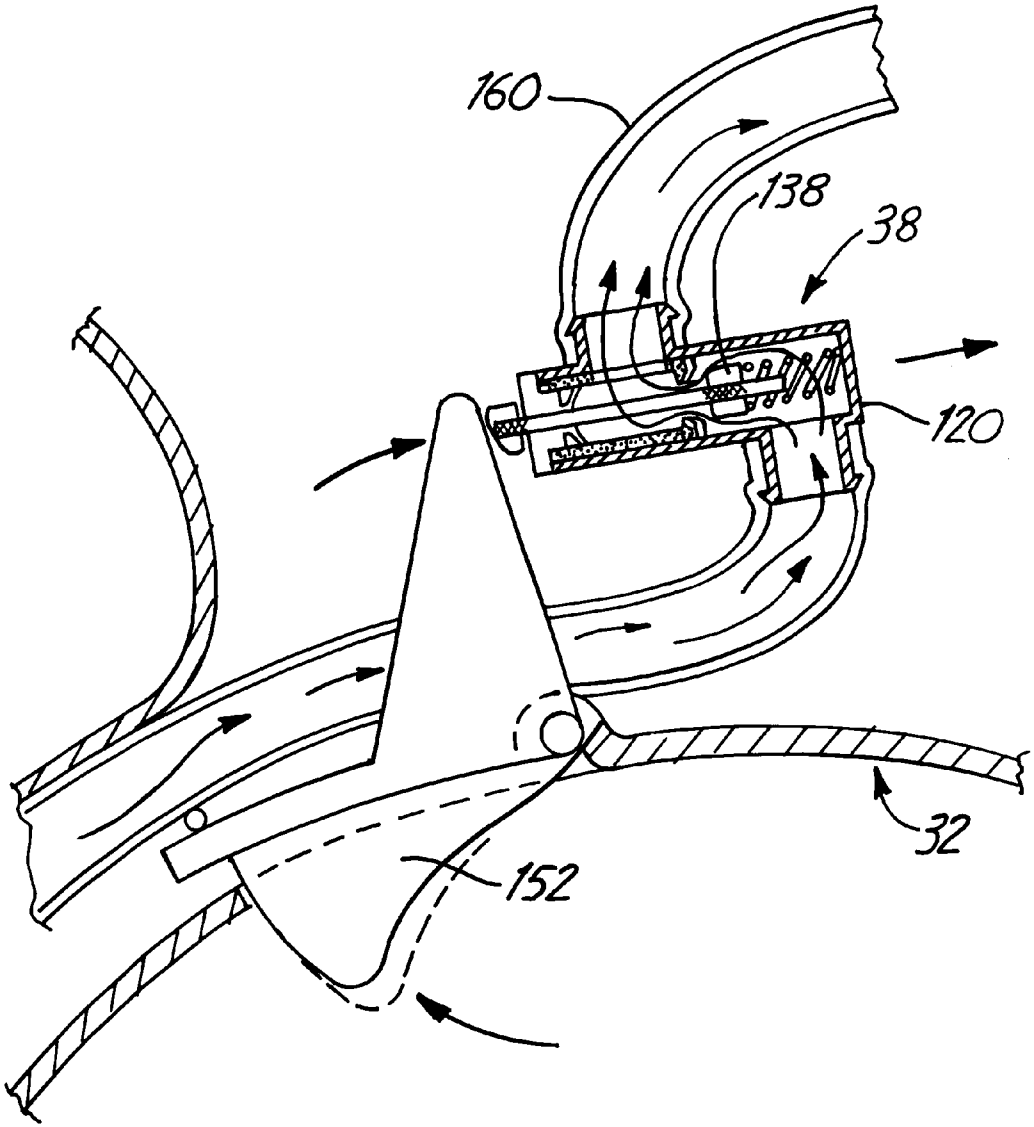
FIG. 14 depicts another embodiment of a trigger assembly for use with the present invention.

FIG. 14 depicts another embodiment of the trigger assembly 38. The components are substantially similar to the embodiment depicted in FIG. 10, but this embodiment is adapted for use without the pump assembly 42. Namely, water under pressure flows directly into the trigger chamber 120 and is blocked there until the stopper 138 is moved from its seat against the plug 142 by moving the trigger member 152, at which time water flows into the conduit 160 leading top the nozzle assembly 40. Thus, as long as the water supply is constant and sufficiently pressurized, when the trigger 152 is pulled, there will be a constant stream of water "fired" by the gun 30.

Figure 15:
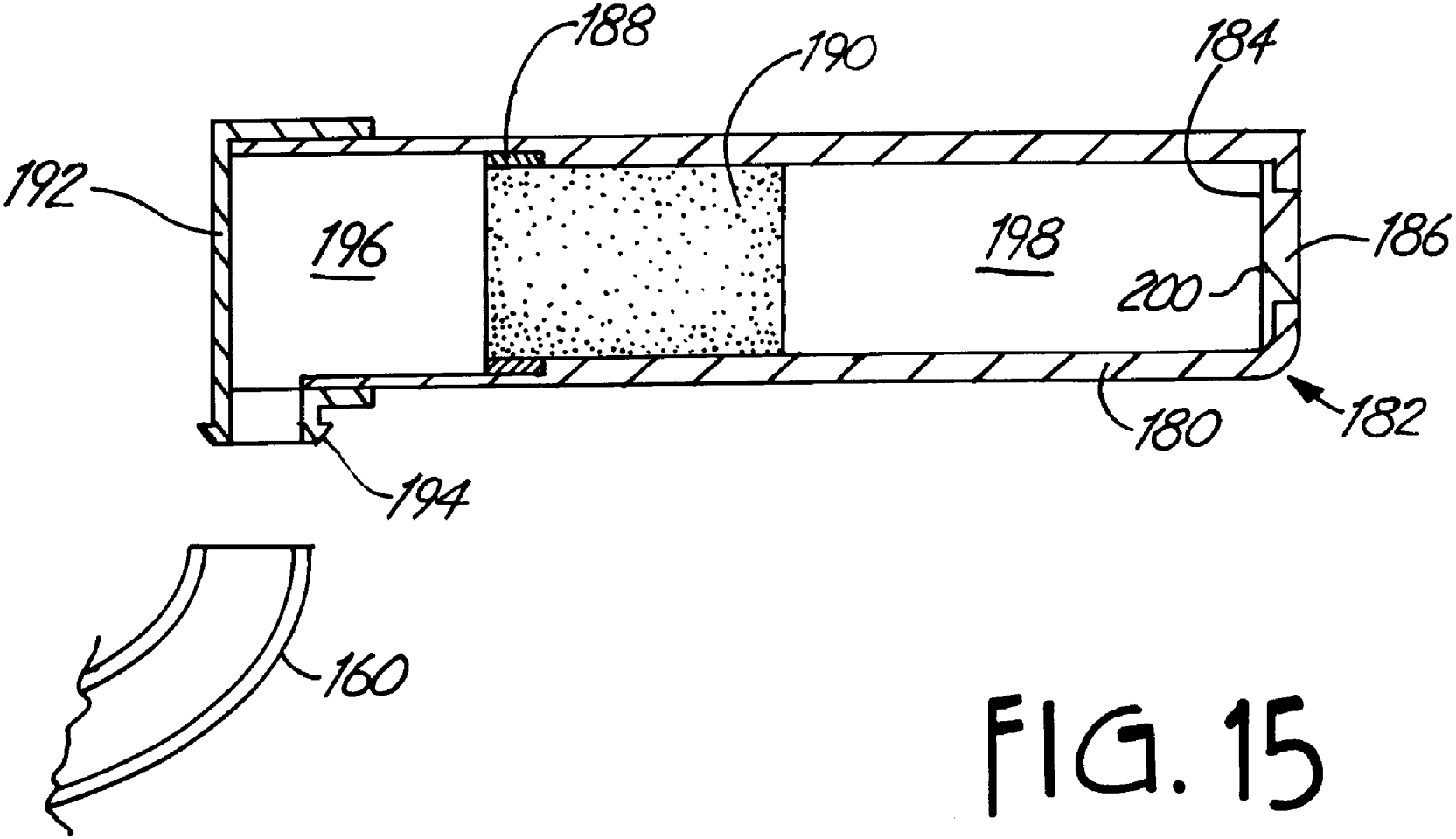
FIG. 15 depicts an embodiment of a nozzle assembly for use in the amusement device of the present invention.

Referring to FIG. 15, one embodiment of a nozzle assembly 40 for use with embodiments of the present invention is depicted. The nozzle assembly 40 comprises a nozzle chamber 180 which is held by the gun body 32. A brass insert 184 is permanently or removably mounted at the outermost or ejection end 182 of the nozzle chamber 180. The insert 184 may also be screwed in place and includes a central aperture 186 from which water flows. Rearwardly of the brass insert 184, the nozzle chamber 180 receives an annular foam support ring 188 which may be glued to the inside wall of the chamber 180. The ring 188 supports a generally cylindrical plug 190 of open cell reticulated foam. The plug 190 may have a diameter generally complimentary to the inner diameter of the chamber 190, or it may be compressible and compressed to fit in the chamber 180. The other end of the nozzle chamber 180 is closed by an end cap 192 which may be glued in place and includes a port 194 for receiving one end of a suitable nozzle feed conduit 160 extending from the water chamber 44.

The nozzle assembly 40 substantially defines a turbulent $H_2O$ initial chamber 196 and a coherent $H_2O$ forward chamber 198 just behind the brass insert 184. In some embodiments, water flow starts in a pressurized chamber 44 associated with a gun 30, proceeds through the trigger valve assembly 38 when it is opened, through the nozzle feed tube 160 into the turbulent H2O chamber 196, through the foam plug 190 which turns it into a coherent flow, and is ejected or shot through the aperture 186 in the as a coherent stream of water under pressure. Referring to FIG. 15, the edge of the aperture 186 in the nozzle insert 184 is beveled sufficiently so that water does not touch the outer edges. In one embodiment, the bevel angle is 45 degrees. This sharp edge, e.g., edge 200, helps to form and maintain the coherent water stream. The term coherent is intended to mean moving in a generally consistent pressure, velocity and direction. A suitable reticulated foam is a 10 ppi open cell PVC coded reticulated foam, but other foams and/or other structures suitable to organize the turbulent water into a coherent flow may be used as well.

Figure 16:
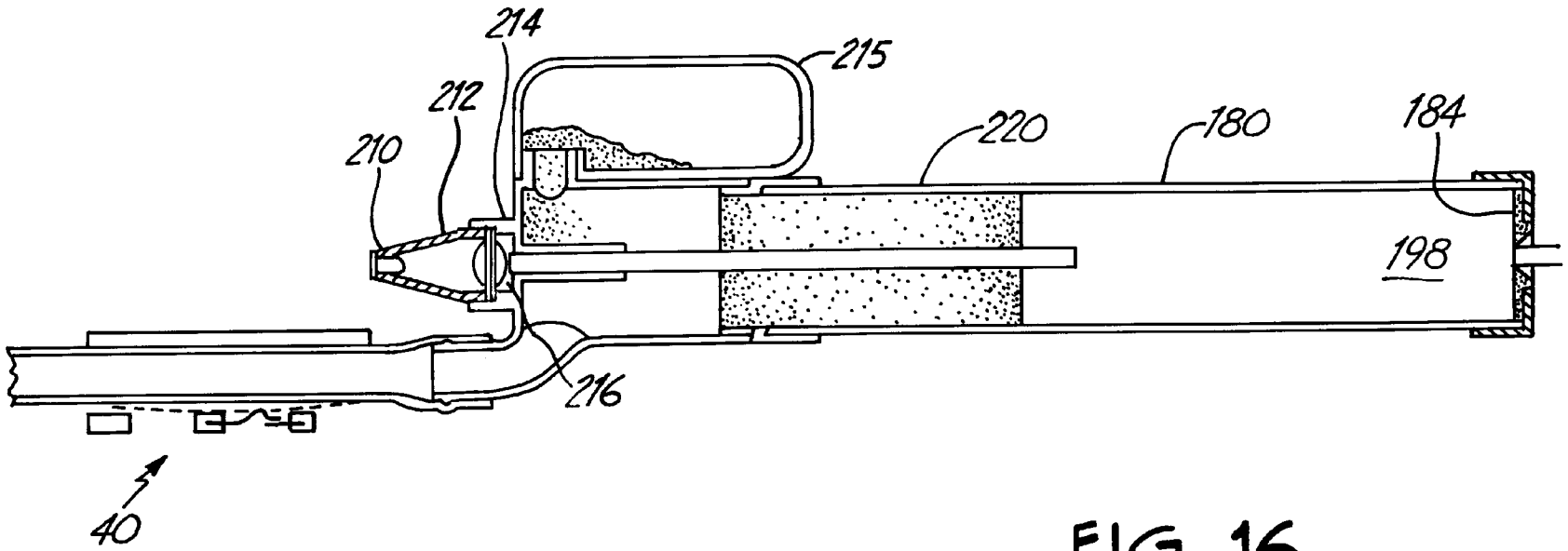
FIG. 16 depicts another embodiment of the nozzle assembly.
Figure 22:
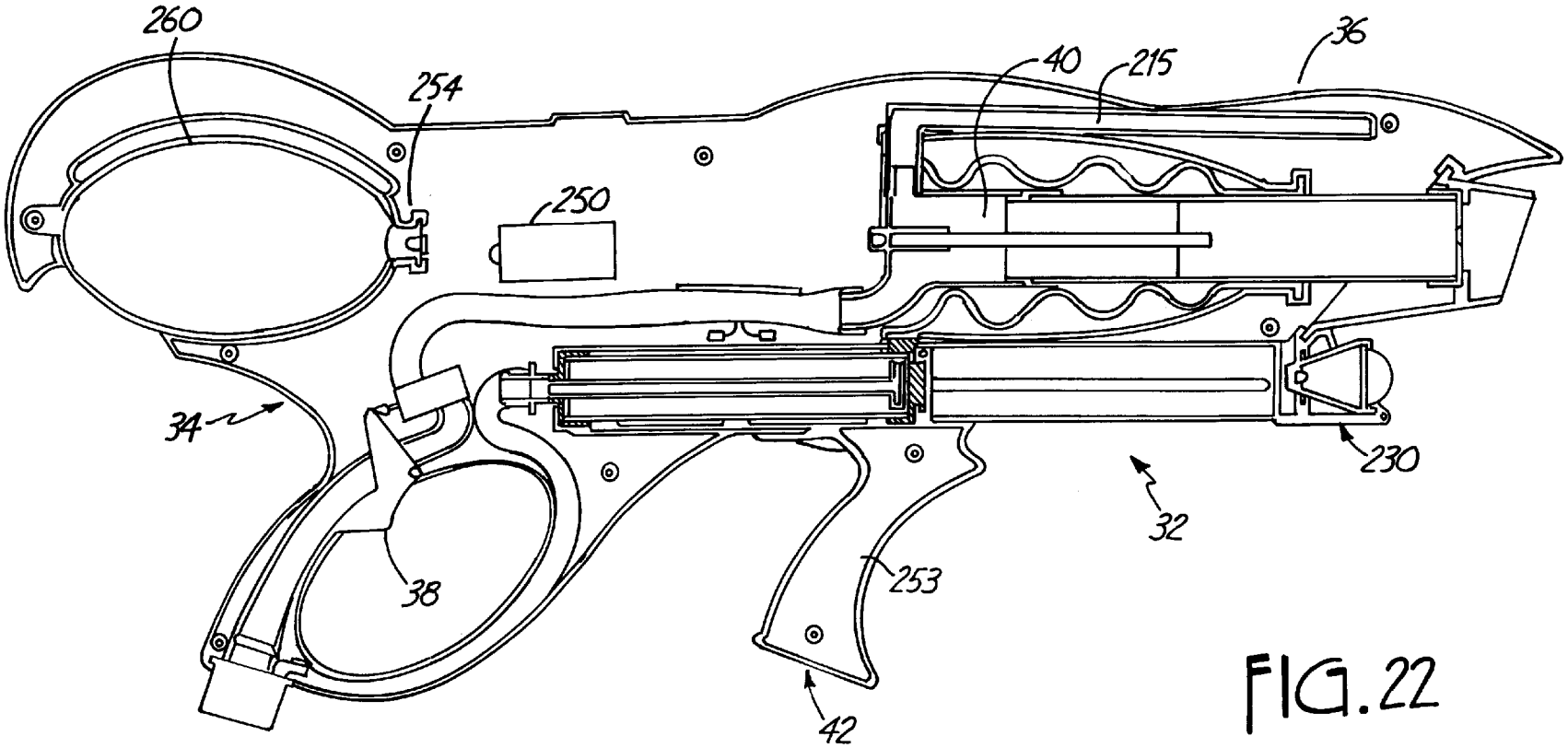
FIG. 22 is a cross-sectional view of another embodiment of the toy squirt gun of the present invention.
Figure 23:
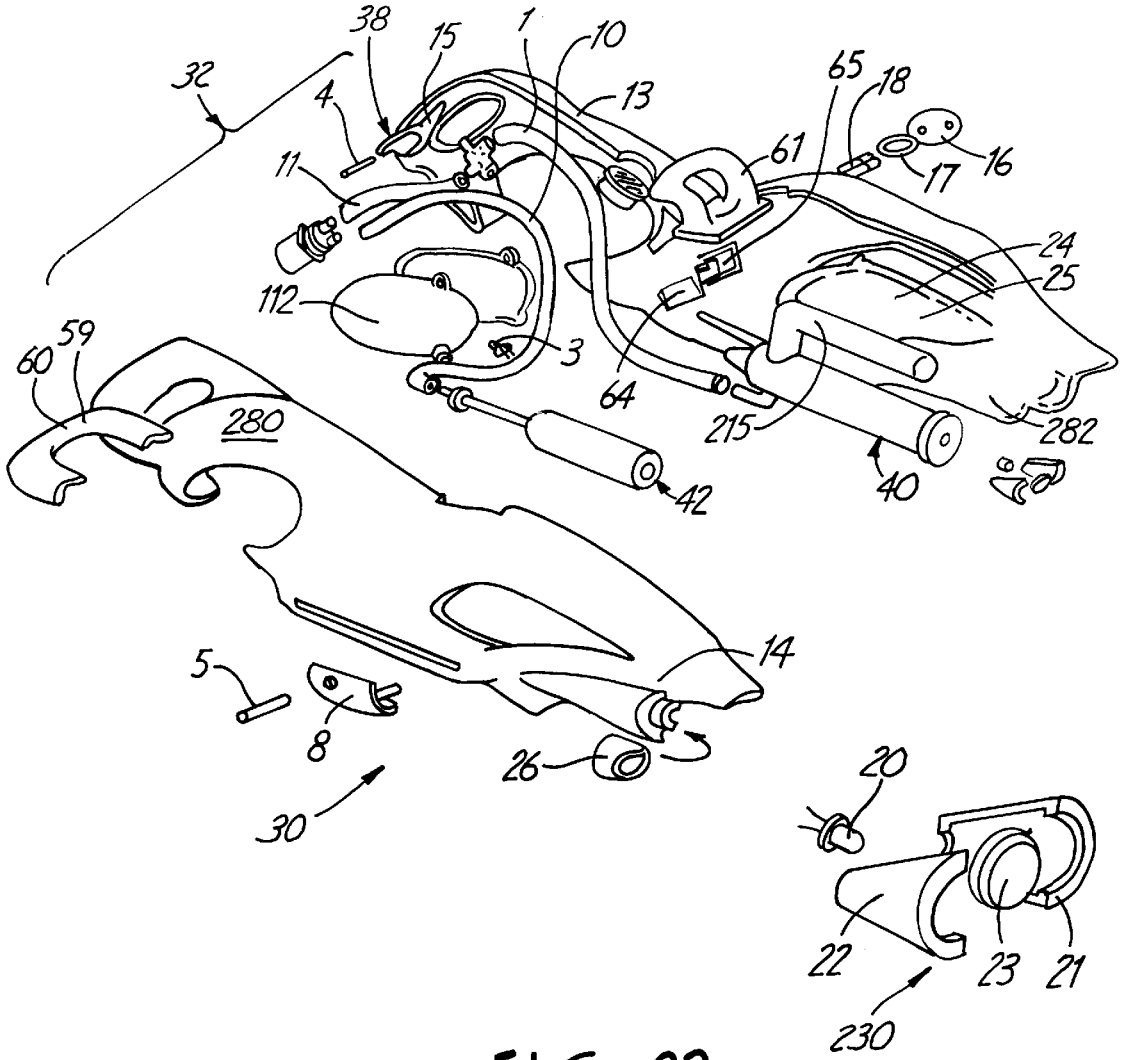
FIG. 23 is an exploded assembly of another embodiment.

FIG. 16 depicts another embodiment of a nozzle assembly 40 wherein a photon LED 210 is mounted at the rear of the nozzle chamber 180. In this embodiment, the photon LED 210, or other suitable light source, is mounted in a waterproof case 212 at the interior end of the nozzle assembly 40 in a suitable fitting 214, and a suitable lens or lenses 216 may be provided to focus the light. Just in front of the lens 216 a suitable light tube or light conductor 220 is mounted generally coaxially with the central longitudinal axis of the nozzle assembly 40. The tube may be aligned with the axis of the nozzle chamber 180 and the center of the aperture 186. Any suitable light conducting member, e.g., a tube, an acrylic rod, an optic fiber, may be used. FIG. 16 also depicts a shock cushion chamber 215 which is provided to hold an air "cushion" to help take vibration or turbulence out of the water to enhance the coherency of the "shot" or ejected coherent stream. This chamber 215 is also shown in FIGS. 22 and 23.

Figure 17:
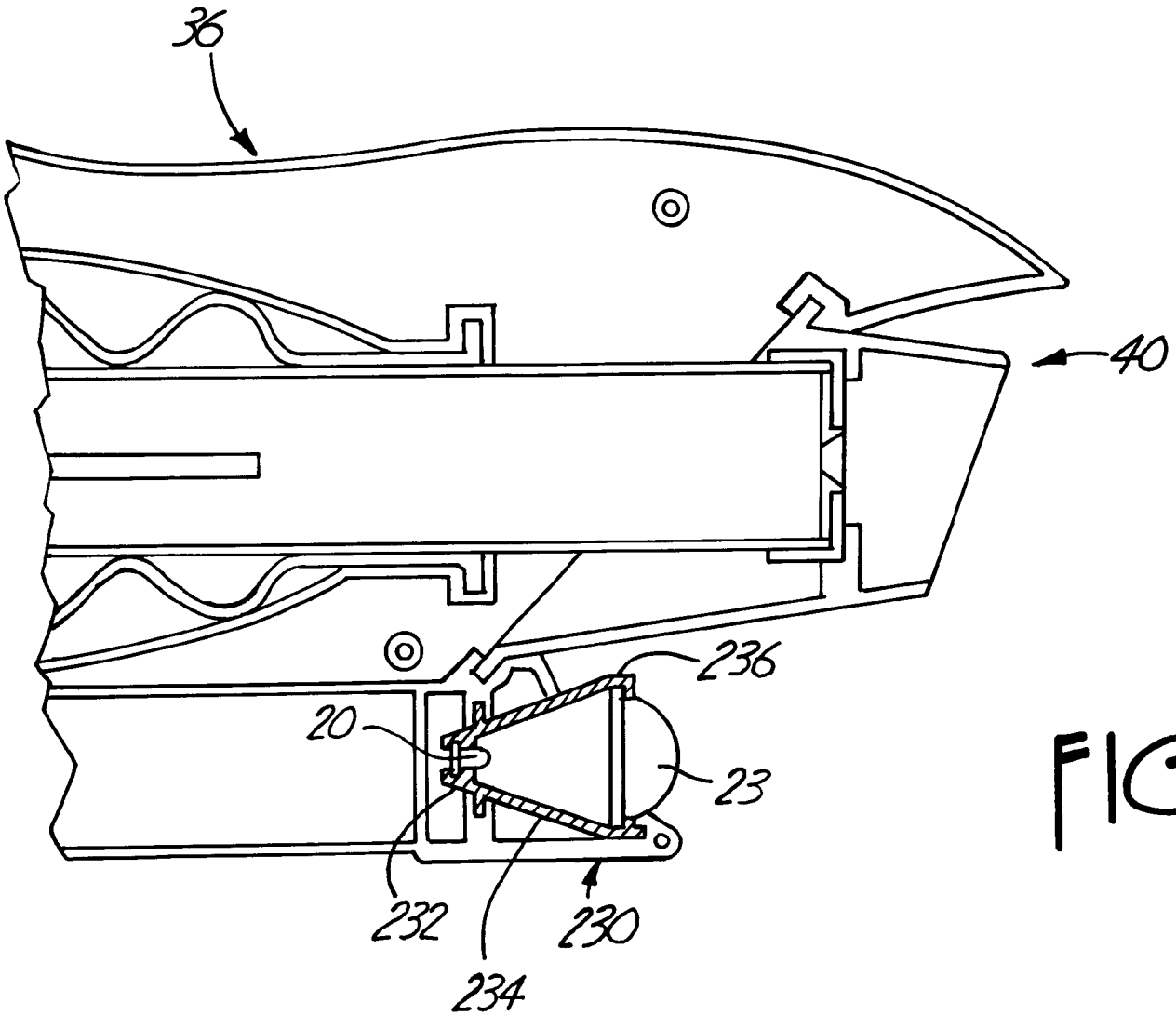
FIG. 17 depicts an embodiment of the toy of the present invention wherein a second light source is provided.

Referring to FIG. 17, a secondary light feature 230 is depicted for use with embodiments of the present invention. Specifically, the secondary light source 230 is mounted adjacent the front end of the gun 30 generally under the nozzle assembly 40. The secondary light includes a photon LED 232, a generally conical LED reflector 234, and a lens 236 (acrylic or other material) which focuses the LED light into a tight, but widening beam to iluminate the water stream being emitted from the nozzle assembly 40. This secondary beam illuminates the water stream and surrounding area. Preferably, the light emitted from the secondary light 230 and the light tube 200 are parallel.

Figure 18A:
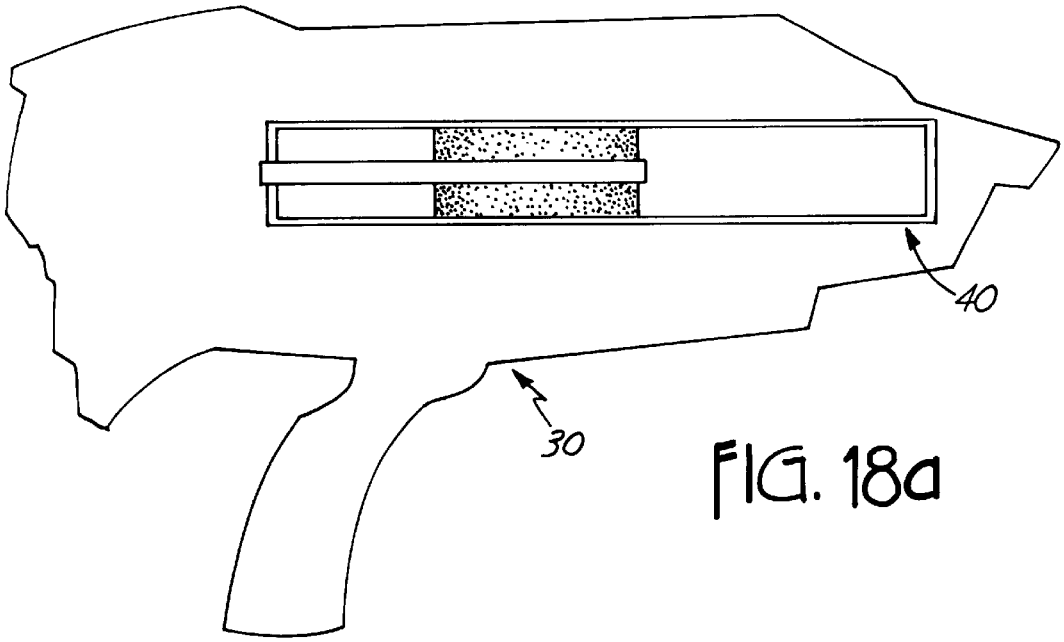
FIGS. 18*a* and 18*b*, depicts embodiments of the nozzle, particularly exemplary ratios for nozzle components.
Figure 18B:
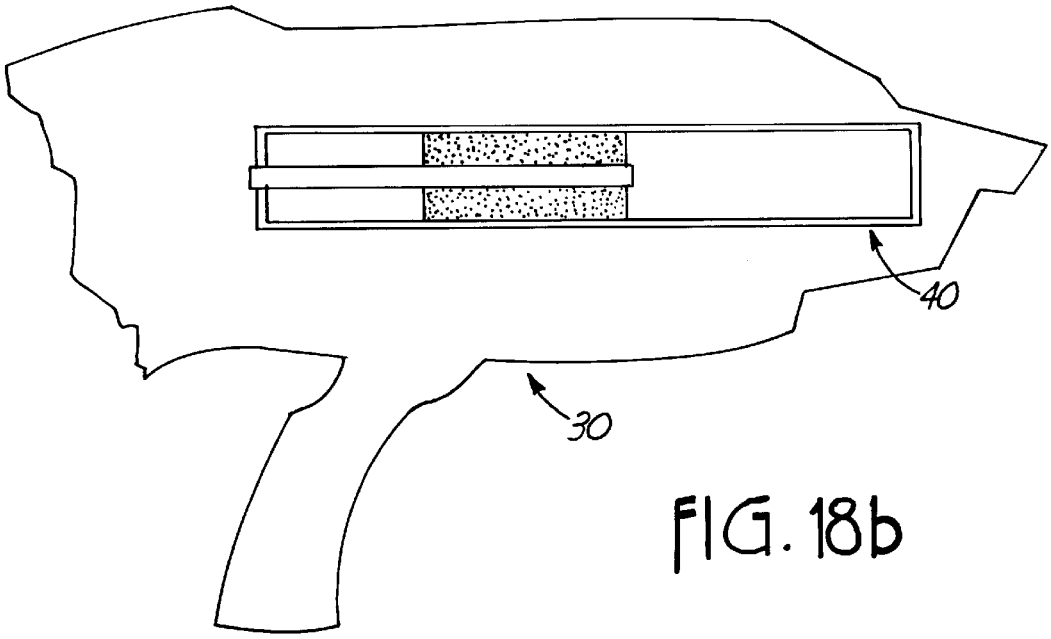

FIGS. 18*a* and 18*b* depict exemplary ratios for nozzle components which help to optimize the coherency and length of the coherent water stream "shot" by a gun 30, as well as the illumination thereof. The ratios may be varied as long as the coherency and length of the coherent water stream is not adversely affected.

Figure 19:
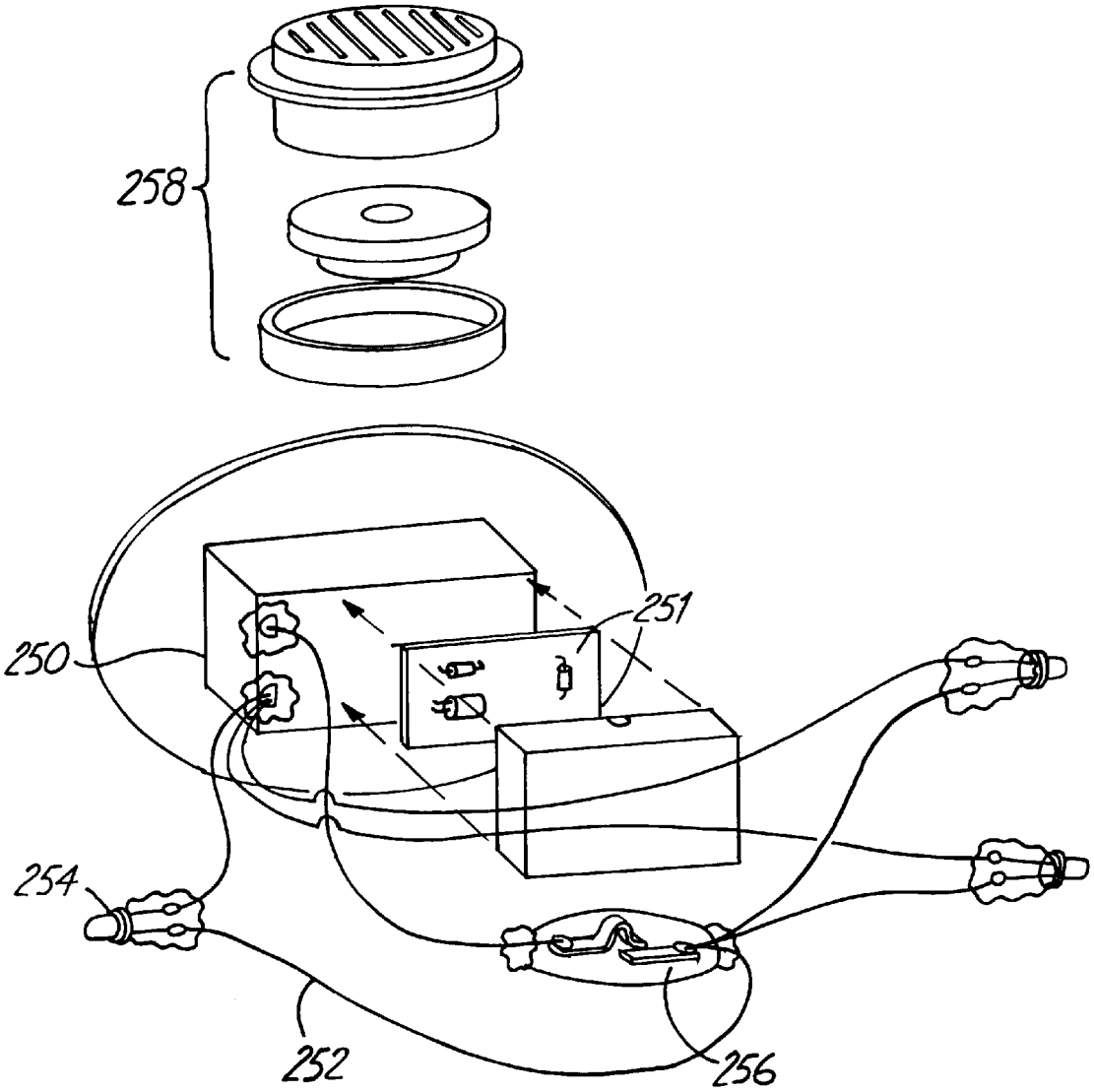
FIG. 19 depicts an embodiment of a representative, exemplary electronic system and/or wiring harness for use in embodiments of the present invention.
Figure 20:
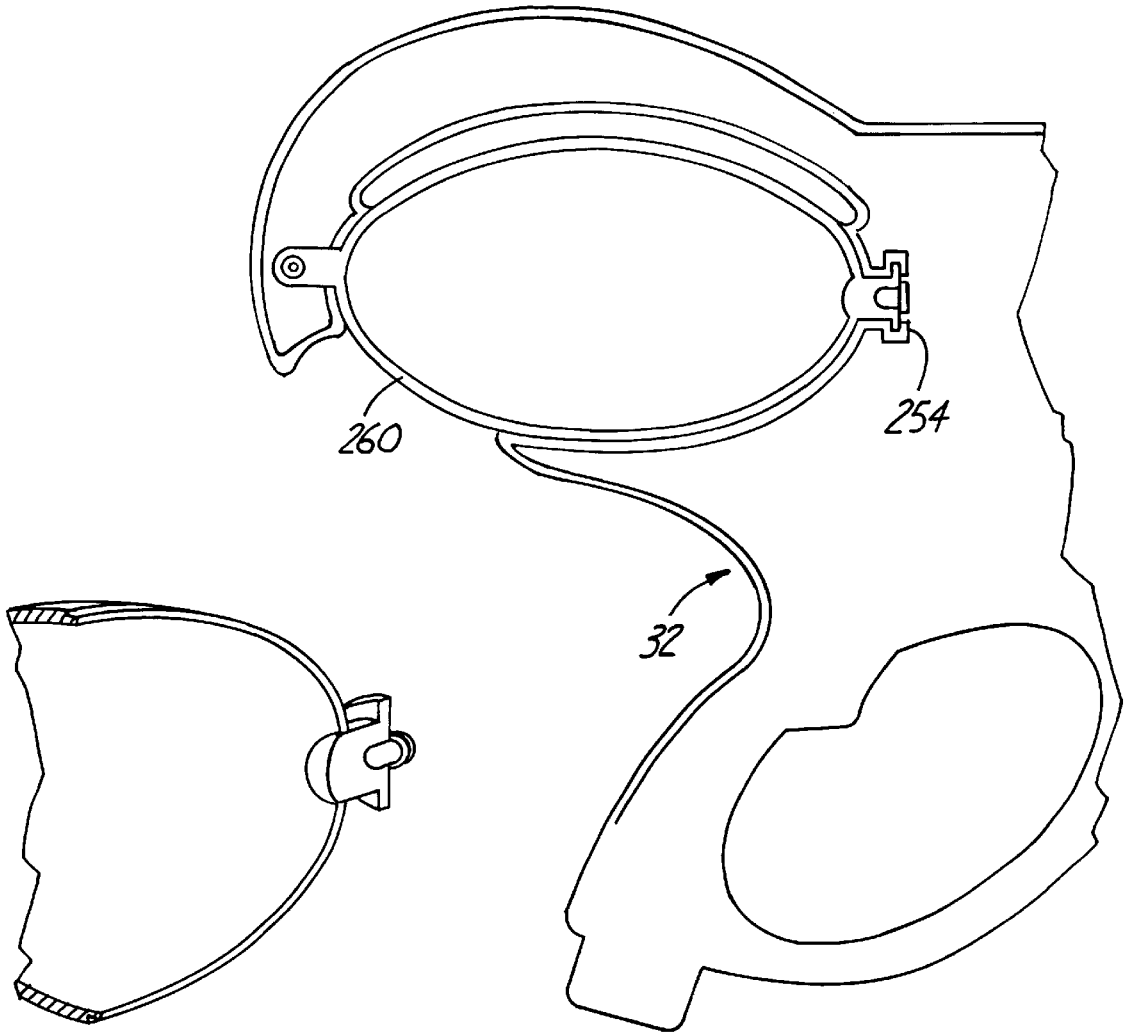
FIG. 20 depicts a "light-up" feature for use with embodiments of the amusement devices in accordance with the present invention.

FIG. 19 depicts an embodiment of an electrical system or wiring harness and electrical components for use in embodiments of the present invention. The system includes a power source box, or battery box 250 which may be located suitably in the body 32 of a gun 30 for containing batteries or another suitable power source. Suitable wires 252 may be used to couple operable components such as LED's 254, switches 256 and speakers 258. These components may be supported and/or contained in the body 32 of guns 30 as shown and taught by referring to FIG. 22. Referring to FIG. 20, one or more portions of gun bodies 32 may be lighted or adapted to glow by providing a suitable light source such as an LED 254 mounted adjacent to a chamber 260 with transparent or translucent walls or at a transparent or translucent portion of a gun body 32. Such light sources 254 may be actuated by pulling the trigger assembly 38 and/or by the flow of pressurized water or they may be actuated separately.

Figure 21:
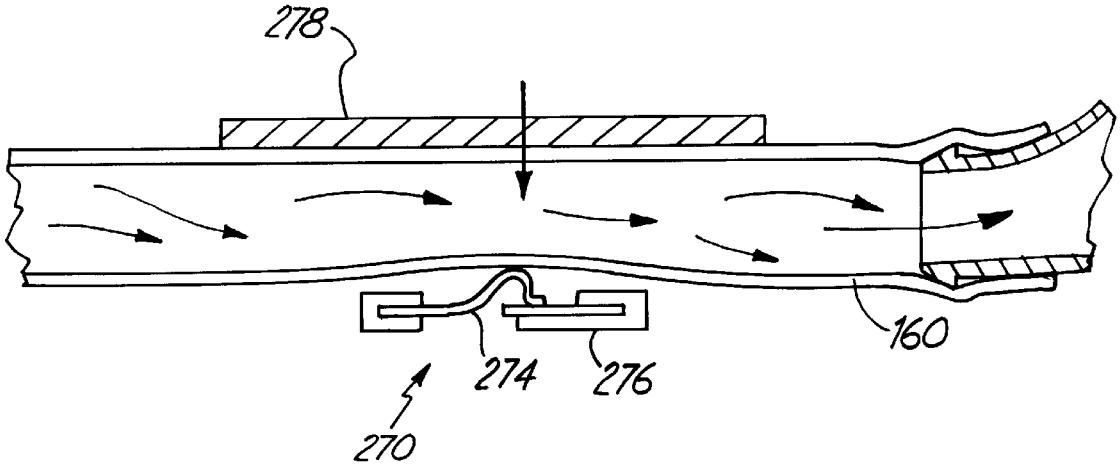
FIG. 21 depicts an embodiment of a control switch for operating aspects of the present invention.

FIG. 21 depicts one embodiment of a switch mechanism 270 adapted to actuate features of a gun 30, e.g., light or sound. The switch 270 is mounted adjacent to a conduit or a flexible or soft portion of a conduit, such as conduit 160 carrying pressurized water to the nozzle 40 when the trigger assembly 38 is actuated. The deformation or expansion of the conduit 160 moves one contact element 274 of the switch into contact with the other element 276. A plate 278 may be provided to "sandwich" the conduit between the plate 278 and switch 270 to facilitate movement of the switch element 274.

Figure 24:
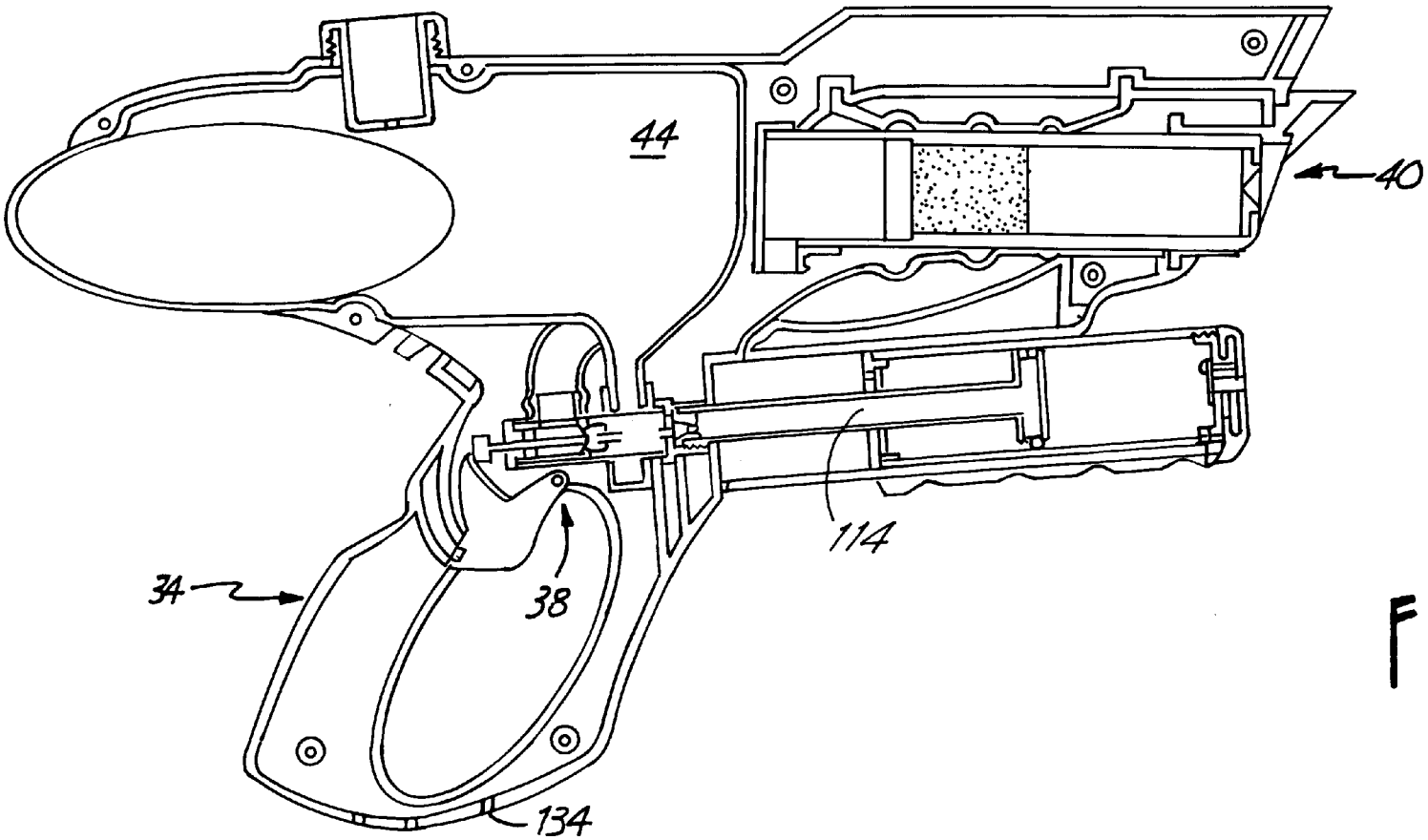
FIG. 24 is a cross-sectional view of another embodiment.

FIGS. 22, 23 and 24 depict embodiments of toy water gun amusement devices 30 in accordance with the present invention. The depicted embodiments are exemplary, and shapes and sizes of the guns 30 and components thereof may be varied. Each embodiment comprises a generally gun-shaped (e.g., pistol, rifle or the like) body 32 having a stock portion 34 and a barrel portion 36. Each embodiment includes a suitable trigger mechanism assembly 38 for actuating the gun, a nozzle assembly 40 for emitting a stream of liquid, and a pump assembly 42 for pressurizing the gun. The embodiment depicted in FIG. 24 includes a water or liquid receiving and/or containing pressurization tank or chamber 44. In the embodiments depicted in FIGS. 24 and 25 there is no gun-carried chamber, use being made of a remote or external supply or source of liquid, including such a source or supply which may be pressurized by the pump assembly 42 of the gun 30. Referring to FIG. 23, the body 32 of the guns 30 may be formed by two or more half body portions 280, 282 which are adapted to support and contain operational components described herein, e.g., the nozzle assembly 40 (e.g., see also FIG. 16), the trigger assembly 38, the pump assembly 42 (e.g., see also FIG. 8), conduits, such as conduit 160, lighting sources or elements such as secondary light source 230 (e.g., see also FIG. 17), etc.

In one embodiment or embodiments of the present invention, the upper, in-stream light, which may be associated with, integrated with or adjacent to the nozzle assembly 40, utilizes a very bright (for example, a 3000 or more microcandle power) LED with a factory incorporated lens to provide for a narrow angle beam. This light assembly may be mounted inside the coherent water nozzle chamber 198 with a waterproof "wire-in-tube" arrangement to get it near the nozzle insert 184. In this embodiment, the end of the tube would incorporate a suitable LED holder, also waterproof. The wires would run out of the chamber, for example, at the back of the chamber, to the batteries in the battery chamber 250. In some embodiments, the end of the tube may incorporate a narrow beam LED which may be mounted inside a chrome plated tube or portion of the tube that acts as a reflector to refine and straighten stray light rays. In some embodiments, such a tube may expand slightly in diameter towards the front.

Generally, the distance between a light source and the nozzle insert 184 is a compromise. If they are too close, water turbulence from the obstruction created by the LED assembly may disrupt the laminar flow, killing the lighted stream effect too quickly as the water leaves the nozzle. If they are too far apart, the LED may lose too much energy inside the chamber. Other variables may affect the distance or positional relationship, including the size of the nozzle, the width of the LED light angle, the diameter and length of the chamber, the water pressure, etc., so the relationship may be determined or calculated for various embodiments of the present invention.

In some embodiments, the light source(s) of the present invention may be an acrylic light rod, optic type fiber, light conductor or the like. In other embodiments, the light source(s) may be a wheat bulb, a phillips type bulb or a laser. Generally, it would be preferred if the selected light source is used with and provides a "glass rod" effect, e.g., a glowing or lighted water stream.

In some embodiments, as shown in FIG. 17, the "in-stream" light source arrangement described herein may be used with a second, lower light source, i.e., a "below stream" light assembly, for example, source 230. The secondary light source below is designed to pick up where the first light leaves off inside the water stream (e.g., at about 3–5 feet) and continue out as a widening beam to catch the downward curved water trajectory out to 20 or more feet. This embodiments is advantageous because, although the single light source embodiments provide a flickering in-stream effect, in some embodiments the effect extends for 3–6 feet depending on light source candlepower, and with a second light source, the stream of water may be lighted for 20 or more feet.

In embodiments including dual beams, one or more LED's may be installed in or near a suitable parabolic chrome plated reflector. The reflector helps collect light that would be lost or dissipated, and directs it substantially all to a lens or lenses. The water trajectory illumination may be done with a pre-tuned lens (or lenses) to achieve the selected beam characteristics. Lenses can be plano-convex and one, two, three or more can be stacked, or the lenses can be Fresnel-type lenses, stacked or single. Focal length may be tuned by adjusting the distance from the LED for desired beam angle. The assembly could alternately be a long tube, metalized Mylar or chrome plated on the inside. This type of arrangement straightens out reflections to some degree without a lens, but could also be capped with a lens for a good beam.

Embodiments of the present invention may use or include a variety of light sources, including LED's, wheat bulbs or phillips type bulbs, as well as laser arrangements. Any embodiment, including those with a reflector or reflectors, might contain two or more LED's or bulbs for extra illumination. Light angle, or the angle at which light from the light sources illuminates the water and/or the area in front of the gun, may adjustable or it may be selectively set permanently at the factory. In some embodiments, a single lower light source may be used.

Different color LED's and/or light sources may be used to create colored illumination of the water stream, e.g., for team use. Also, two alternating or blinking colored light sources could be used, for example, in one of or both lower and upper light sources, giving rise to a flickering, multicolor lighted water stream effect. In some embodiments, a beam or light recognition sensor, target and/or like system may be integrated with a gun or carried or worn as a patch, badge, shield or the like. It may be a CDS light sensor color recognizing system with red-green filters over the sensors, and may be for night scoring use.

Sound effects may be provided in the present invention by integrating, for example, an appropriate sound chip or microprocessor 251 (See, for example, FIG. 19.). Suitable microprocessors or chips may be used to control other functions, e.g., light sequencing, pressure sensing, etc., as well.

Some embodiments of the present invention may incorporate or provide an infra-red (IR) scoring system, and such systems may include light and sound effects.

Some embodiments may include a vibrator or reciprocating motorized weight to cause "bullets" or bursts of water, as well as provide tactile excitement when shooting the gun.

Some coherent stream or laminar water flow embodiments of the present invention may include a water chamber wherein water enters the chamber from below and the chamber includes a rigid or flexible air tube 215 above for shock absorption (See, for example FIGS. 16, 22 and 23.). The water-receiving chamber 196 of the nozzle assembly 40 may have a chamber star baffle to reduce the turbulence of water coming in, and/or a chamber straw stack (not shown, but, e.g., envision a stack of drinking straws or similar structure inside the chamber) to reduce turbulence. The nozzle insert 184 may be stainless steel, plastic, or other material, and may be the full width of the chamber 198 so that any seam is as far as possible from the nozzle orifice 186. This is advantageous to help keep the water flow laminar out the nozzle orifice. In some embodiments, the optimum chamber volume may be less than four times the air/water tank volume, otherwise the first shot may just fill the chamber, with nothing coming out of the gun. Thus, in some embodiments, there may be a desirable minimum ratio.

Various trigger valve designs may be used in the present invention, and each embodiment may have differences. In some embodiments, the trigger assembly 38 may include a geared strip and geared ball valve with spring. In some embodiments, the spring may be removed from the water flow, to help reduce the turbulence/friction of water flowing across and through a spring. In some embodiments, the piston, seal and other components may be streamlined for promoting better water flow. In some embodiments, there may be a 45 degree ramp in some valves to help direct flow without turbulence. Generally, depending on the arrangement of components, a "12.5 mm rule" may be recognized: all connectors, restrictions and tubes bearing or carrying water may have a minimum I.D. of approximately 12.5 mm in order to optimize flow and water stream distance. In embodiments wherein the valve piston opens off the seal, leaving a donut shaped hole, this hole should add up to at least the area found in a 12.5 mm diameter hole. Preferably, wherever there is a right angle bend, restriction, material or shape transition or the like, e.g., such as the rod that pushes the piston, or a step where connectors come together, the opening areas should be proportionately larger than a 12.5 mm diameter circle area to compensate for or reduce parasitic drag. The "12.5 mm rule" derived from distance testing of multiple embodiments of guns with a 3.5 mm nozzle—range began to fall off quickly when inside diameters were below 12.5 mm. However, with appropriate selection and arrangement of components, the 12.5 mm rule is not absolute.

Figure 2:
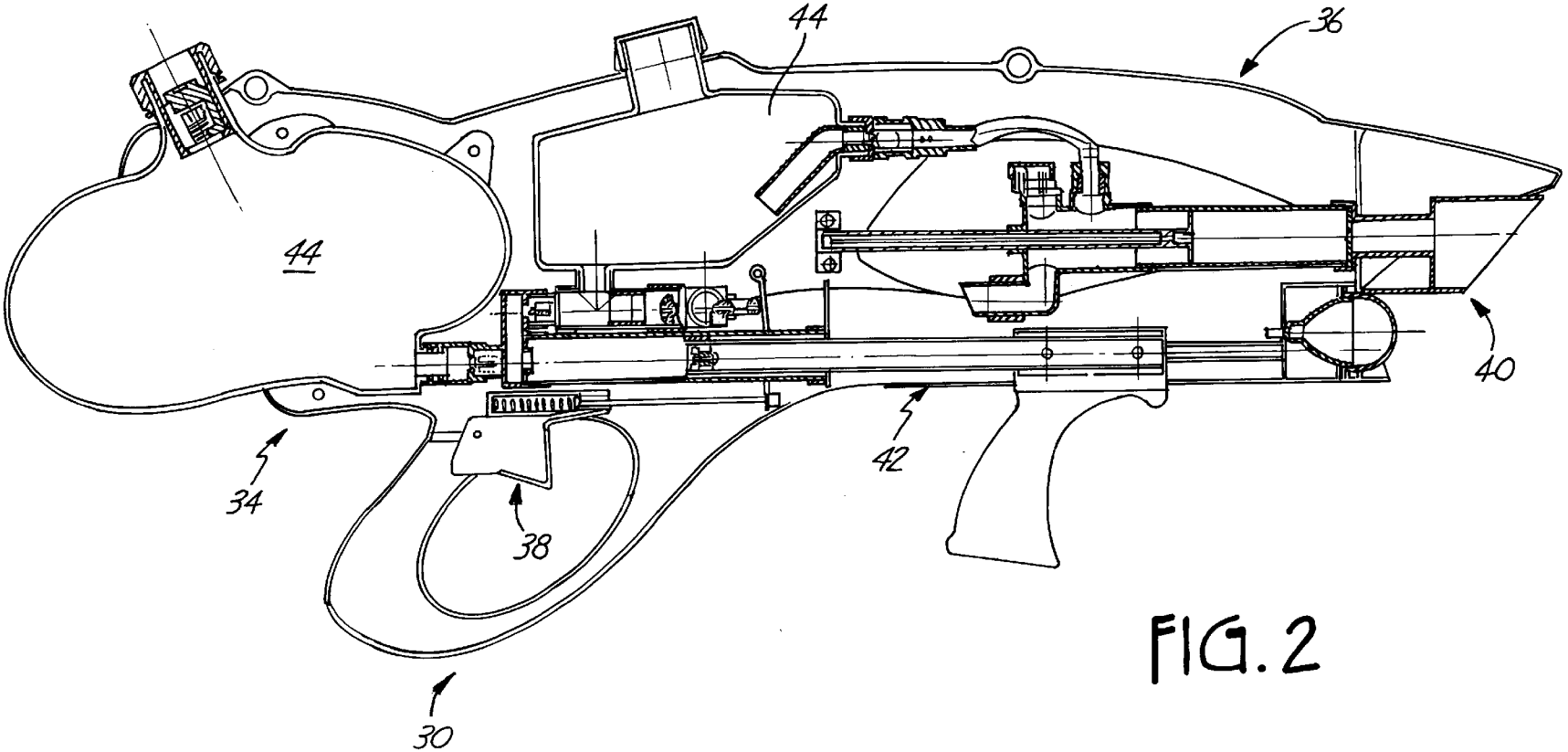
FIG. 2 is a cross-sectional view depicting another embodiment of the amusement device of the present invention.
Figure 3:
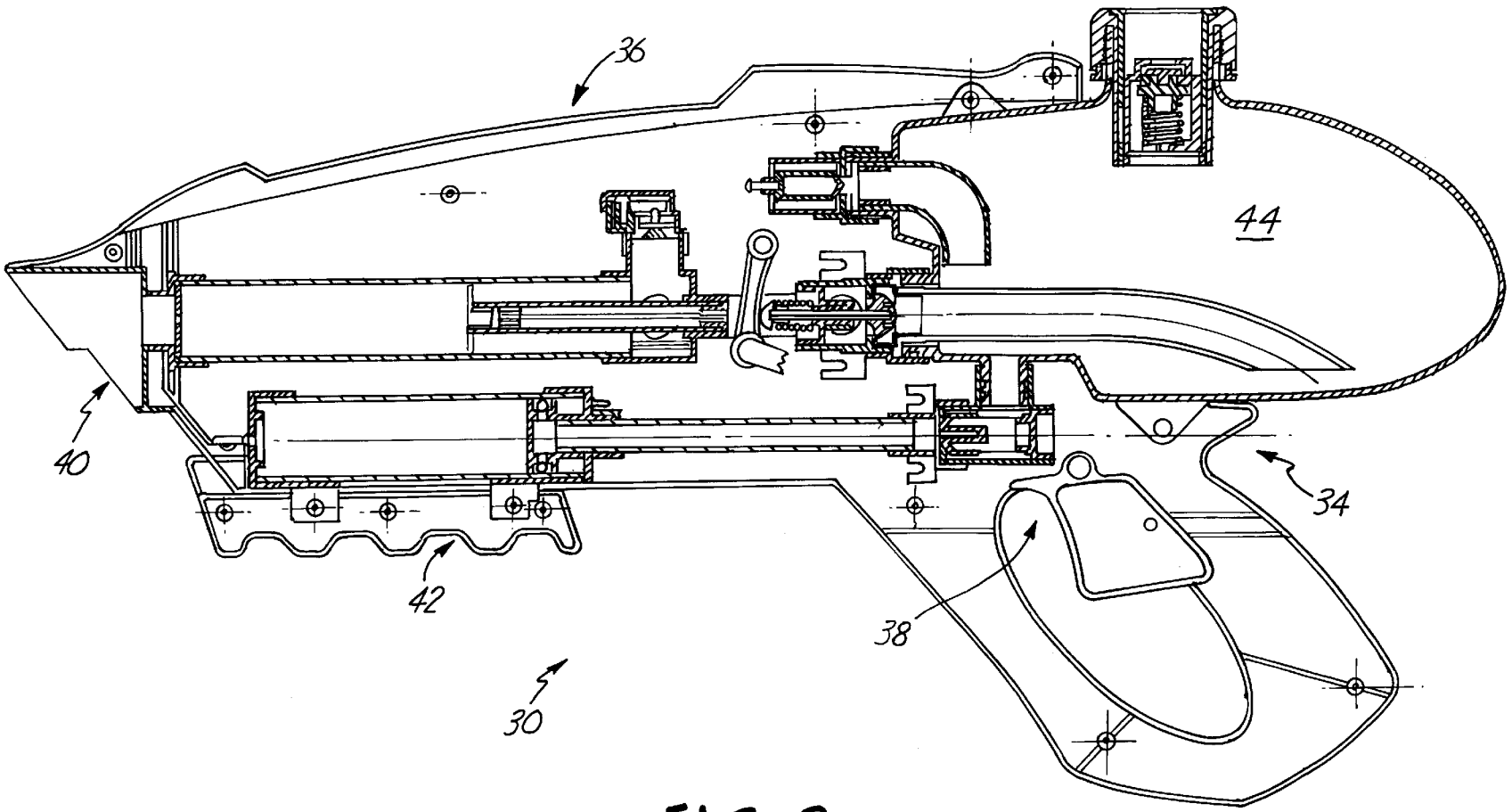
FIG. 3 is a cross-sectional view depicting another embodiment of the amusement device of the present invention.
Figure 4:
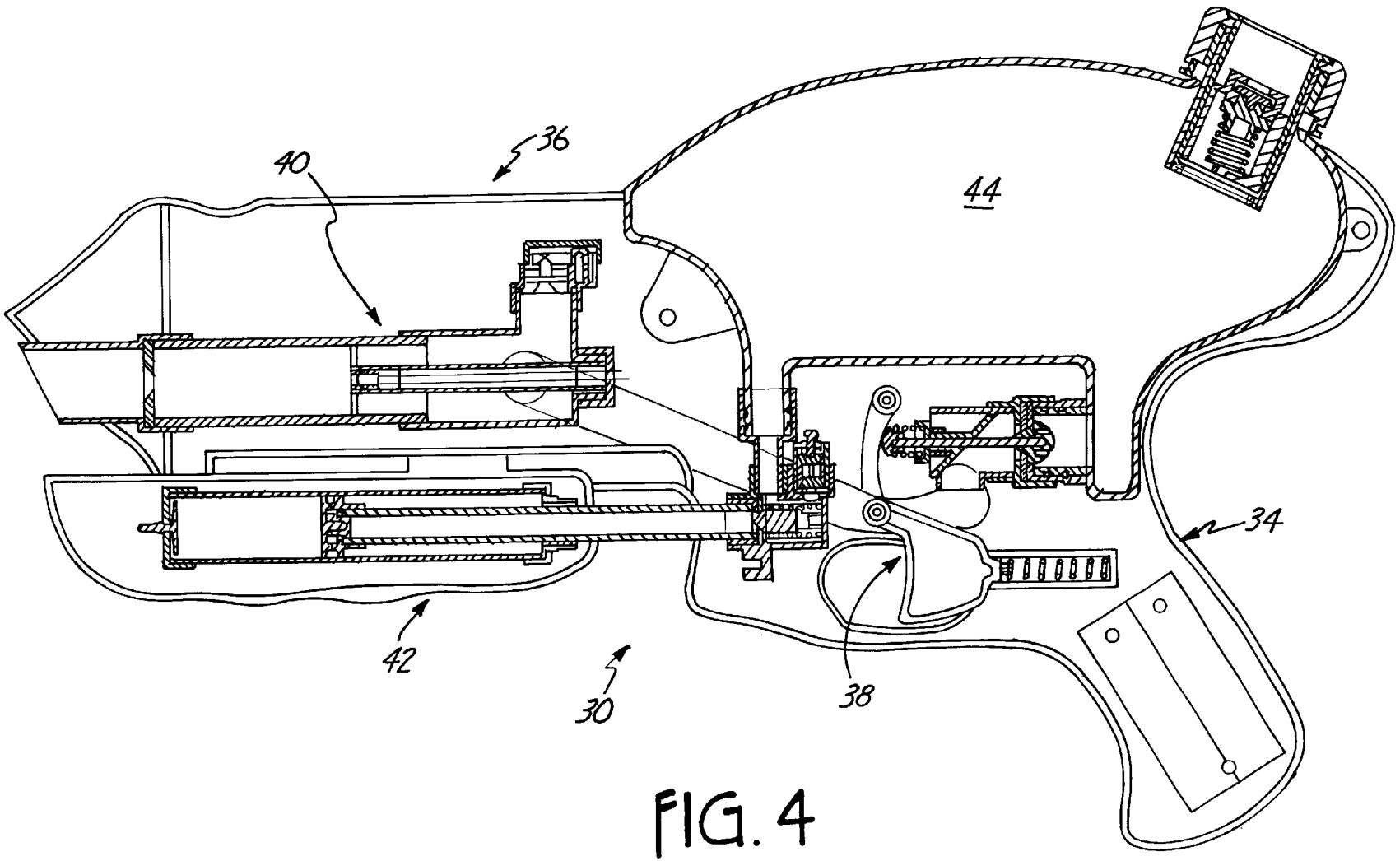
FIG. 4 is a cross-sectional view depicting another embodiment of the amusement device of the present invention.
Figure 5:
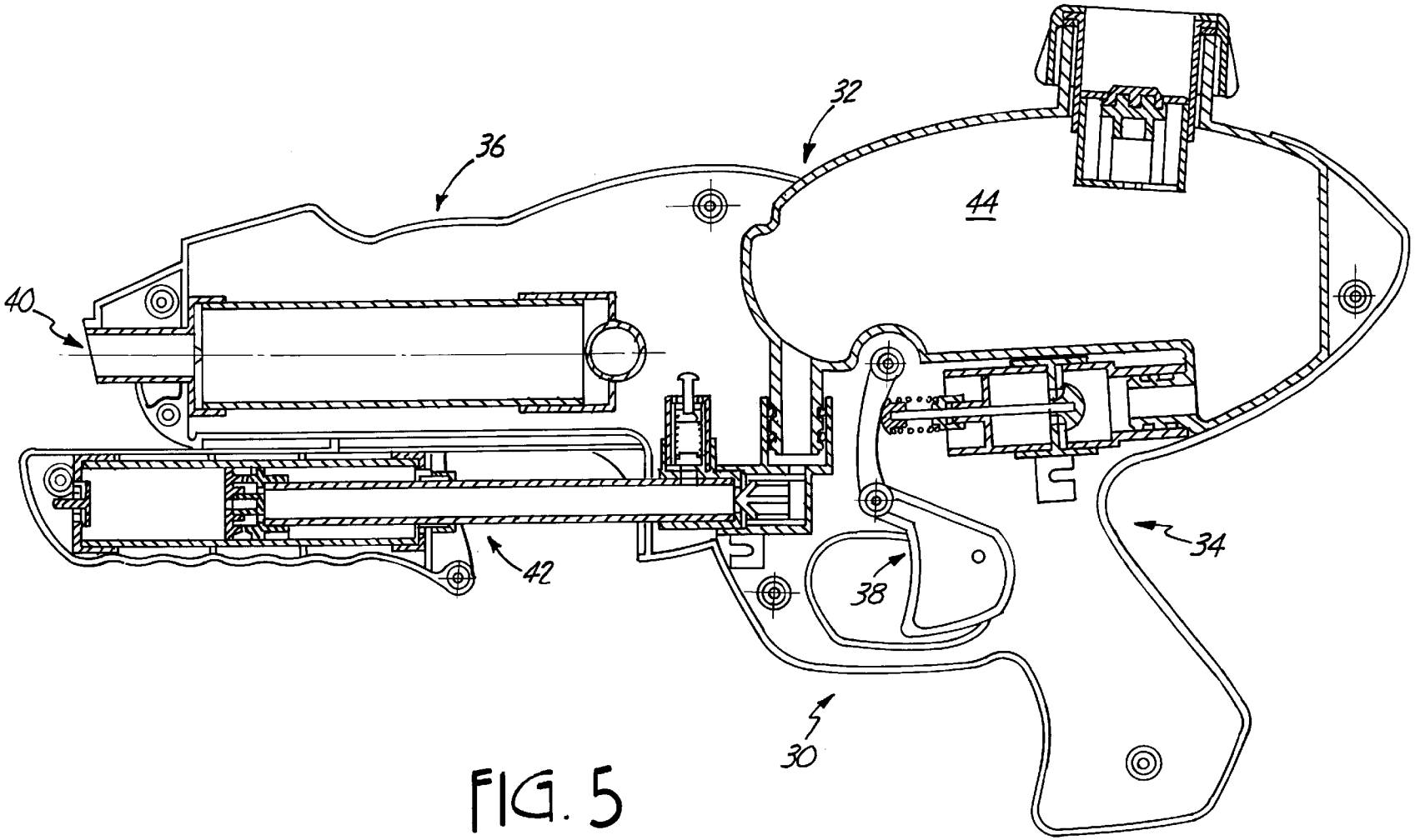
FIG. 5 is a cross-sectional view depicting another embodiment of the amusement device of the present invention.
Figure 6:
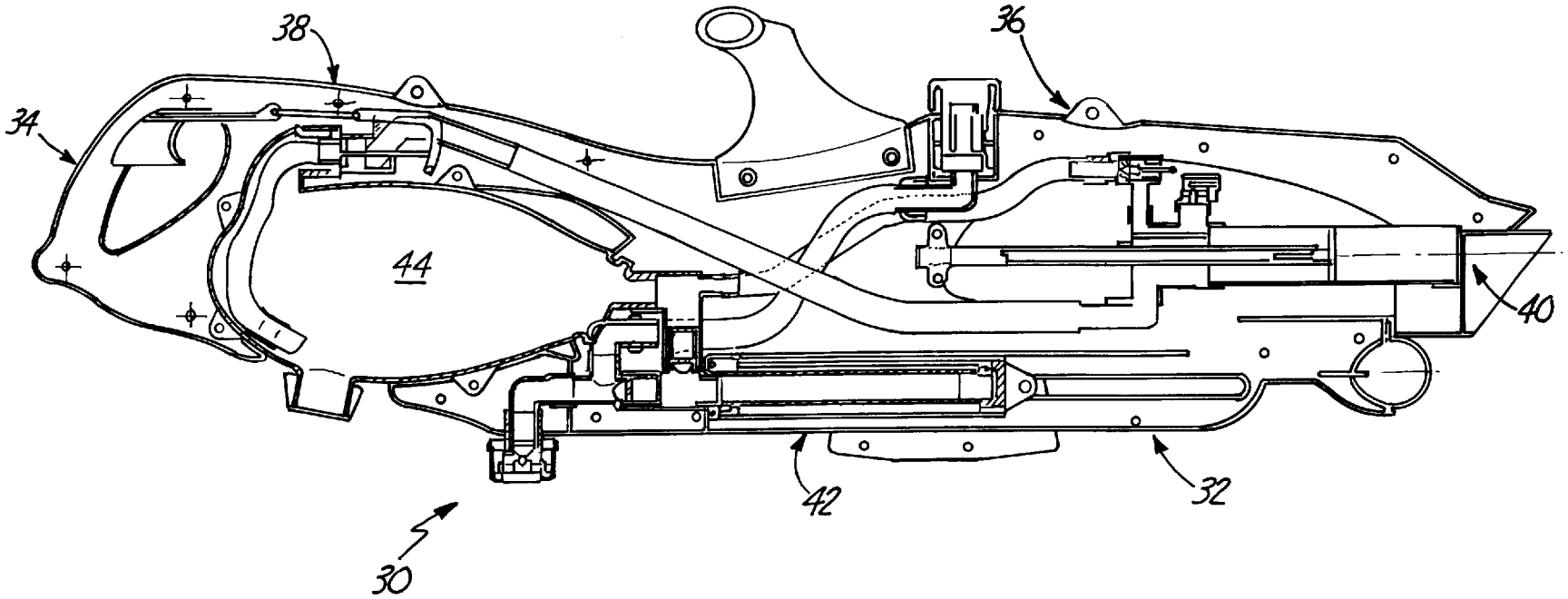
FIG. 6 is a cross-sectional view depicting another embodiment of the amusement device of the present invention.

The present invention encompasses the use of an "Unlimitor" 90 for proviing for a continuous stream of water when the trigger is pulled. With reference to FIGS. 2 and 28, the "Unlimitor" comprises a selected length of suitable conduit or hose with a connection structure 96 at each end, typically a male connector at one end and a female connector at the other end. The end 96 to be connected to one of the embodiments of the toy gun of the present invention may be bent, e.g., at a right angle as shown, to facilitate connection to the gun 30, and to facilitate the use of the gun 30 to accurately direct a stream or shot of water. Either or both ends could be bent or shaped to facilitate connection to a gun and/or to a water source, e.g., a spigot. The "Unlimitor" may be used with a pressure pop off valve or without. Also, the present invention is intended to encompass a multi-gun Unlimitor splitter to allow more than one "Unlimitor" to be put on the same garden hose or water source. In one embodiment, this may comprise an attachment with multiple male threaded ends. Any length of conduit or hose may be used.

The present invention is intended to encompass guns 30 without a gun-carried tank design, a two-tank design or a one tank design; any may be adapted for use with a "backpack" water supply. In-tank, or in conduit or hose, filters or filter screens may be provided.

In some embodiments, as long as desired pressurization may be achieved, the pump handle or pump handle portions of the gun body 32 (see, e.g., handle portion 253 in FIG. 22) may be attached to and able to move the piston and the rod, while the cylinder remains stationary relative to the body of the gun. Pump handles on other embodiments may be attached to and able to move the cylinder, while the piston and rod remain stationary relative to the body of the gun.

In some embodiments, an internal "pop off" valve 126 is provided so tanks and fittings do not exceed recommend pressures.

In some embodiments, a pressure switch, e.g., switch 270 depicted in FIG. 21, may be provided to activate the light source or sources, and/or the light can only come on if water is flowing through the toy or when water is shooting through or leaving the nozzle. Some embodiments, including those with larger water capacity, may include a shut-off valve at some point in the water flow path or adjacent to the end of the gun adjacent the nozzle to keep water from draining out of the water chamber when the toy is not in use. This valve may be optional for embodiments with reduced chamber size, e.g., 10 g chamber volume, since there would not be much water to drain.

In some embodiments, the water gun amusement devices 30 of the present invention may be adapted for "back flushing," i.e., to receive water or other suitable liquid at the nozzle or other location whereby the water or liquid may flow into and/or through all or a portion of the amusement device in a cleansing flow generally in the opposite direction of the flow during regular use. In some embodiments, a threaded fitting may be provided around the nozzle of the gun, and may be adapted to fit a standard garden hose hose-end. Coupling a hose to the fitting and turning on the water, and/or pulling the trigger, allows for a reverse water flow through all or a portion of the embodiment to clean operational structures if, for example, the user notices the gun is not shooting water as well as possible due to particles stuck in the nozzle, notwithstanding the screen in the tank. In some embodiments, the tank screens and/or other operational structures may be removable, to allow for complete cleaning of the removable part and for complete back flushing and cleaning of the gun. Advantageously, periodic back flushing will likely increase the life of the water gun amusement devices of the present invention by removing sand or other particles from the device (such particles may wear down rubber seals such as those in the trigger valve). To back flush some embodiments, the front of a gun may be coupled to a hose, the tank cap(s) may be opened, and the screen(s) may be removed. The hose is then turned on, and the gun is held upside down while the trigger is pulled for a selected amount of time or until back flushing is complete. In some embodiments, the nozzle may be mounted so that it cannot be pushed back into the gun under pressure.

The amusement devices 30 of the present invention may be used with a disappearing ink feature. In one exemplary embodiment, a suitable non-toxic powder or concentrate may be added into the tank by the user, whereby when mixed with water and shot through the gun at a target, a temporary bright color stain will appear on the target. Any suitable chemicals may be used.

In addition to the embodiments and changes set forth above, the present invention may be embodied in other specific forms without departing from the essential spirit or attributes thereof. The described embodiments should be considered in all respects as illustrative, not restrictive, and reference should be made to the appended claims for determining the scope of the invention.

What is claimed is:

1. A toy gun for shooting a stream or burst of liquid, wherein the gun comprises a housing having a front end, a rear end, an internal chamber for containing a liquid and a portion for containing a source of electricity, a conduit connected to the chamber and to a nozzle at the front end, a pump for pressurizing the chamber for forcing a stream of liquid through the conduit and out of the nozzle, valve structures suitable for controlling the flow of liquid, including for making the stream of liquid coherent, a light source adjacent to the front end for illuminating a stream of liquid, means for coupling and operating the means for illuminating and the source of electricity, and a trigger mechanism connected to the housing for actuating a stream of liquid, wherein the nozzle comprises a turbulent liquid initial chamber connected to an end of the conduit, a coherent liquid forward chamber, a generally cylindrical plug of foam located between the chambers, and a nozzle insert located at an ejection end of the coherent liquid forward chamber.

2. The toy gun according to claim 1, further comprising a purge valve mechanism operably coupled to the internal chamber.

3. The toy gun of claim 1, wherein the nozzle insert is beveled sufficiently so that water does not touch the outer edges.

4. The toy gun of claim 1, wherein the plug is open cell PVC coated reticulated foam.

5. The toy gun of claim 1, further comprising a light conductor mounted generally coaxially with a central longitudinal axis of the nozzle.

6. The toy gun of claim 1, further comprising a shock cushion chamber located adjacent to the nozzle, wherein the shock cushion chamber holds an air cushion to help take turbulence out of the liquid to enhance the coherency of the ejected coherent stream.

7. A water gun amusement device comprising:

(i) a body;

(ii) water flow path structures including a nozzle assembly supported by the body, the nozzle assembly comprising a turbulent water initial chamber, a coherent water forward chamber, a plug of foam located between the chambers, and a nozzle insert located at an ejection end of the coherent water forward chamber;

(iii) a trigger valve assembly operably coupled to the water flow path structures and to the body for controlling a water flow;

(iv) a source of electricity; and (v) at least one light source for illuminating a shot of water, wherein the shot of water is lighted and coherent.

8. The water gun amusement device of claim 7, wherein the nozzle insert is beveled sufficiently so that water does not touch the outer edges.

9. The water gun amusement device of claim 8, wherein the bevel angle is approximately 45 degrees.

10. The water gun amusement device of claim 7, wherein the plug is open cell PVC coated reticulated foam.

11. The water gun amusement device of claim 7, further comprising a light conductor mounted generally coaxially with a central longitudinal axis of the nozzle assembly.

12. The water gun amusement device of claim 11, wherein the light conductor is an acrylic rod.

13. The water gun amusement device of claim 11, wherein the light conductor is an optic fiber assembly.

14. The water gun amusement device of claim 7, further comprising a shock cushion chamber located adjacent to the nozzle assembly, wherein the shock cushion chamber holds an air cushion to help take turbulence out of the water to enhance the coherency of the ejected coherent stream.

15. The water gun amusement device of claim 7, further comprising a pressurization chamber supported by the body, the chamber designed to contain water.

16. The water gun amusement of claim 15, further comprising a purge valve mechanism operably coupled to the chamber.

17. The water gun amusement of claim 15, further comprising a pump for pressurizing the chamber for forcing a stream of water through the flow path and out of the nozzle assembly.

18. A toy gun for shooting a stream of liquid, comprising:

a body having a stock portion and a barrel portion;

a conduit for a liquid flow path supported by the body;

a trigger assembly operably coupled to the conduit for controlling the liquid flow through the body;

a nozzle assembly comprising a turbulent liquid initial chamber, a coherent liquid forward chamber, a plug of foam located between the chambers, and a nozzle insert located at an ejection end of the coherent liquid forward chamber, the nozzle assembly supported by the body and connected to an end of the conduit;

a source for electricity; and at least one light source for illuminating the liquid as it is shot out of the nozzle assembly, wherein the nozzle assembly is designed to create a coherent stream of liquid.

19. A water gun amusement device comprising:

(i) a body;

(ii) water flow path structures including a nozzle assembly supported by the body;

(iii) a trigger valve assembly operably coupled to the water flow path structures and to the body for controlling a water flow;

(iv) a source of electricity;

(v) at least one light source for illuminating a shot of water, wherein the shot of water is lighted and coherent; and (vi) a light conductor mounted generally coaxially with a central longitudinal axis of the nozzle assembly.

20. The water gun amusement device of claim 19, wherein the nozzle assembly comprises a turbulent water initial chamber, a coherent water forward chamber, a plug of foam located between the chambers, and a nozzle insert located at an ejection end of the coherent water forward chamber, and wherein the nozzle insert is beveled sufficiently so that water does not touch the outer edges.

21. The water gun amusement device of claim 20, wherein the bevel angle is approximately 45 degrees.

22. The water gun amusement device of claim 19, wherein the nozzle assembly comprises a turbulent water initial chamber, a coherent water forward chamber, a plug of foam located between the chambers, and a nozzle insert located at an ejection end of the coherent water forward chamber, and wherein the plug is open cell PVC coated reticulated foam.

23. The water gun amusement device of claim 19, wherein the light conductor is an acrylic rod.

24. The water gun amusement device of claim 19, wherein the light conductor is an optic fiber assembly.

25. The water gun amusement device of claim 19, further comprising a shock cushion chamber located adjacent to the nozzle assembly, wherein the shock cushion chamber holds an air cushion to help take turbulence out of the water to enhance the coherency of the ejected coherent stream.

26. The water gun amusement device of claim 19, further comprising a pressurization chamber supported by the body, the chamber designed to contain water.

27. The water gun amusement of claim 26, further comprising a purge valve mechanism operably coupled to the chamber.

28. The water gun amusement of claim 26, further comprising a pump for pressurizing the chamber for forcing a stream of water through the flow path and out of the nozzle assembly.

29. A water gun amusement device comprising:

(i) a body;

(ii) water flow path structures including a nozzle assembly supported by the body;

(iii) a trigger valve assembly operably coupled to the water flow path structures and to the body for controlling a water flow;

(iv) a source of electricity;

(v) at least one light source for illuminating a shot of water, wherein the shot of water is lighted and coherent; and (vi) a shock cushion chamber located adjacent to the nozzle assembly, wherein the shock cushion chamber holds an air cushion to help take turbulence out of the water to enhance the coherency of the ejected coherent stream.

30. The water gun amusement device of claim 29, wherein the nozzle assembly comprises a turbulent water initial chamber, a coherent water forward chamber, a plug of foam located between the chambers, and a nozzle insert located at an ejection end of the coherent water forward chamber, and wherein the nozzle insert is beveled sufficiently so that water does not touch the outer edges.

31. The water gun amusement device of claim 30, wherein the bevel angle is approximately 45 degrees.

32. The water gun amusement device of claim 29, wherein the nozzle assembly comprises a turbulent water initial chamber, a coherent water forward chamber, a plug of foam located between the chambers, and a nozzle insert located at an ejection end of the coherent water forward chamber, and wherein the plug is open cell PVC coated reticulated foam.

33. The water gun amusement device of claim 29, further comprising a light conductor mounted generally coaxially with a central longitudinal axis of the nozzle assembly, wherein the light conductor is an acrylic rod.

34. The water gun amusement device of claim 29, further comprising a light conductor mounted generally coaxially with a central longitudinal axis of the nozzle assembly, wherein the light conductor is an optic fiber assembly.

35. The water gun amusement device of claim 29, further comprising a pressurization chamber supported by the body, the chamber designed to contain water.

36. The water gun amusement of claim 35, further comprising a purge valve mechanism operably coupled to the chamber.

37. The water gun amusement of claim 35, further comprising a pump for pressurizing the chamber for forcing a stream of water through the flow path and out of the nozzle assembly.

38. A toy gun for shooting a stream or burst of liquid, wherein the gun comprises a housing having a front end, a rear end, an internal chamber for containing a liquid and a portion for containing a source of electricity, a conduit connected to the chamber and to a nozzle at the front end, a pump for pressurizing the chamber for forcing a stream of liquid through the conduit and out of the nozzle, valve structures suitable for controlling the flow of liquid, including for making the stream of liquid coherent, a light source adjacent to the front end for illuminating a stream of liquid, means for coupling and operating the means for illuminating and the source of electricity, and a trigger mechanism connected to the housing for actuating a stream of liquid, and a light conductor mounted generally coaxially with a central longitudinal axis of the nozzle.

39. The toy gun according to claim 38, further comprising a purge valve mechanism operably coupled to the internal chamber.

40. The toy gun of claim 39, wherein the nozzle comprises a turbulent liquid initial chamber connected to an end of the conduit, a coherent liquid forward chamber, a generally cylindrical plug of foam located between the chambers, and a nozzle insert located at an ejection end of the coherent liquid forward chamber, and wherein the nozzle insert is beveled sufficiently so that water does not touch the outer edges.

41. The toy gun of claim 39, wherein the nozzle comprises a turbulent liquid initial chamber connected to an end of the conduit, a coherent liquid forward chamber, a generally cylindrical plug of foam located between the chambers, and a nozzle insert located at an ejection end of the coherent liquid forward chamber, and wherein the plug is open cell PVC coated reticulated foam.

42. The toy gun of claim 39, further comprising a light conductor mounted generally coaxially with a central longitudinal axis of the nozzle.

43. A toy gun for shooting a stream or burst of liquid, wherein the gun comprises a housing having a front end, a rear end, an internal chamber for containing a liquid and a portion for containing a source of electricity, a conduit connected to the chamber and to a nozzle at the front end, a pump for pressurizing the chamber for forcing a stream of liquid through the conduit and out of the nozzle, valve structures suitable for controlling the flow of liquid, including for making the stream of liquid coherent, a light source adjacent to the front end for illuminating a stream of liquid, means for coupling and operating the means for illuminating and the source of electricity, a trigger mechanism connected to the housing for actuating a stream of liquid, and a shock cushion chamber located adjacent to the nozzle, wherein the shock cushion chamber holds an air cushion to help take turbulence out of the liquid to enhance the coherency of the ejected coherent stream.

44. The toy gun according to claim 43, further comprising a purge valve mechanism operably coupled to the internal chamber.

45. The toy gun of claim 43, wherein the nozzle comprises a turbulent liquid initial chamber connected to an end of the conduit, a coherent liquid forward chamber, a generally cylindrical plug of foam located between the chambers, and a nozzle insert located at an ejection end of the coherent liquid forward chamber, and wherein the nozzle insert is beveled sufficiently so that water does not touch the outer edges.

46. The toy gun of claim 43, wherein the nozzle comprises a turbulent liquid initial chamber connected to an end of the conduit, a coherent liquid forward chamber, a generally cylindrical plug of foam located between the chambers, and a nozzle insert located at an ejection end of the coherent liquid forward chamber, and wherein the plug is open cell PVC coated reticulated foam.

* * * * *